US008960529B2

(12) United States Patent
Kimoto et al.

(10) Patent No.: US 8,960,529 B2
(45) Date of Patent: Feb. 24, 2015

(54) FARE BOX

(71) Applicant: Lecip Corporation, Motosu, Gifu (JP)

(72) Inventors: Kenji Kimoto, Motosu (JP); Yasuhiro Suzuki, Motosu (JP); Takashi Matsuno, Motosu (JP)

(73) Assignee: Lecip Corporation, Motosu (JP)

( * ) Notice: Subject to any disclaimer, the term of this patent is extended or adjusted under 35 U.S.C. 154(b) by 0 days.

(21) Appl. No.: 14/159,165

(22) Filed: Jan. 20, 2014

(65) Prior Publication Data

US 2014/0197008 A1 Jul. 17, 2014

Related U.S. Application Data

(63) Continuation of application No. 13/979,882, filed as application No. PCT/JP2012/000306 on Jan. 19, 2012, now Pat. No. 8,668,134.

(30) Foreign Application Priority Data

Jan. 21, 2011 (JP) ..... 2011-011283
Nov. 10, 2011 (JP) ..... 2011-246842

(51) Int. Cl.
*G07B 15/00* (2011.01)
*G07D 11/00* (2006.01)

(52) U.S. Cl.
CPC ..... *G07D 11/0003* (2013.01); *G07D 11/0018* (2013.01); *G07B 15/00* (2013.01)
USPC ..... 232/7; 194/206; 194/350

(58) Field of Classification Search
USPC ..... 232/7, 9, 12, 15, 16, 44, 1 D; 109/66, 109/67; 194/202, 206, 350, 351, 344, 346
See application file for complete search history.

(56) References Cited

U.S. PATENT DOCUMENTS 4,372,478 A 2/1983 Gomez et al.
4,407,312 A 10/1983 Davila et al.
4,453,667 A * 6/1984 Zerfahs ..... 232/7
4,471,905 A * 9/1984 Sloma et al. ..... 232/12
4,540,117 A * 9/1985 Landry ..... 232/7

(Continued)

OTHER PUBLICATIONS

Sheidt & Bachmann USA, Inc., VARE-point, the next generation of mobile fare collection, catalogue, Sep. 2008, 6 pages, Scheidt & Bachman USA, Inc., Burlington, MA USA.

(Continued)

*Primary Examiner* — William Miller
(74) *Attorney, Agent, or Firm* — Yoshida & Associates, LLC

(57) ABSTRACT

Provided is a fare box which enables passengers to smoothly pay fares using bills without hesitation even when a bill transportation passage is disabled due to jamming of a bill or a breakdown. Two entrances, which are a bill normal receiving opening and a bill backup receiving opening, are provided as bill receiving openings of the fare box. Either of the bill normal receiving opening and the bill backup receiving opening is allowed to be selectively opened by a shutter member. At normal times, the bill normal receiving opening is put into operation with the shutter member positioned at a normal position. When a bill normal transportation passage has become jammed with a bill, the shutter member is shifted from the normal position to a bypass position on the basis of an operation performed on a bill receiving opening switch lever, whereby the bill backup receiving opening is opened instead of the bill normal receiving opening.

4 Claims, 26 Drawing Sheets

(56) References Cited

U.S. PATENT DOCUMENTS

| | | | | |
|---|---|---|---|---|
| 4,877,179 | A | 10/1989 | Baker et al. | |
| 4,977,502 | A * | 12/1990 | Baker et al. | 705/13 |
| 6,039,164 | A | 3/2000 | Waters | |
| 7,191,933 | B2 * | 3/2007 | Miyaji | 235/10 |
| 2005/0087424 | A1 * | 4/2005 | Newsome et al. | 194/320 |

OTHER PUBLICATIONS

ACS Transport Solutions Inc., ACS Farebox FBE420, catalogue, 2008, 6 pages,ACS Transport Solutions Inc., Norcross, GA USA.

GFI Genfare, Odyssey Validating Farebox, catalogue, 2001, 4 pages, 4/08, GFI Genefare, Elk Grove Village, IL USA.

* cited by examiner

FARE BOX

TECHNICAL FIELD

The present invention relates to a fare box to receive coins and bills paid as fares.

BACKGROUND ART

Conventionally, a fare box (refer to Japanese Patent 2008-97431A) to receive fares paid by passengers is installed in the public transportation such as a bus or a streetcar. A fare box is provided with a coin acceptor, a bill acceptor, a magnetic card reader, a smart card reader to receive fares in response to various payment methods. Coins received by a coin acceptor and paper bills received by a bill acceptor are stored in a cashbox provided in the fare box.

However, the states of bills inserted into a bill acceptor are various, and, for example, a wrinkled bill may be inserted. Then, there is a risk that the wrinkled bill causes a paper jam on a bill transportation passage in a main body of the fare box. There is also a risk that a bill validator, which is embedded inside a fare box to identify the legitimacy and denomination of bills, stops acceptance of bills by being disabled by a smudge or a trouble inside thereof from properly validating bills, and experiences a jam of a bill due to a malfunction thereof.

When a fare box has stopped properly accepting bills due to jamming of a bill or a mechanical breakdown, a waiting passenger cannot use a bill to pay the fare. A fare box is usually locked in order to prevent passengers and crews from performing illicit acts, and people other than a person having the authority to manage a key for the fare box are not allowed to perform internal maintenance. Therefore, even at the occurrence of jamming of a bill in a fare box, the cover of the fare box cannot be opened to resolve the trouble, and it requires the operation of the bus to be continued in the condition where bills cannot be accepted until the bus is forwarded to a garage after the end of the operation.

Therefore, for example, a technique (refer to Japanese Patent 2002-293468A) employing a bypass passage provided as an alternative pathway inside of a bill transportation unit apart from a normal passage (a bill normal transportation passage) to send bills was devised for transporting a bill to the cashbox through the bypass passage after the occurrence of jamming of a bill in the bill normal transportation passage. Even with the occurrence of jamming of a bill or a breakdown in the bill normal transportation passage, transportation of bills to be accepted later is allowed through the bypass passage by the adoption of this technique, whereby continuously accepting bills without dissolving jamming of the bill or the breakdown is made possible.

In the technique of Japanese Patent 2002-293468A, however, a bill acceptor is shared by the bill normal transportation passage and the bypass passages although these two passages are separately provided. Therefore, when the bill validator is disabled from determining the legitimacy of bills as a result of jamming of a bill or a breakdown in the bill normal transportation passage, a passenger cannot see whether a bill can be received and may hesitate to insert a bill. Further, a passenger may try to insert a bill without knowing that acceptance of bills has been stopped. This requires an extra time for the passenger to board or exit the bus, which brings the risk that the bus may fall behind the schedule. Thus, countermeasures to receive a bill smoothly after the occurrence of jamming of a bill or a breakdown are in demand.

SUMMARY OF INVENTION

The present invention is intended to provide a fare box which enables a passenger to smoothly pay a fare using a bill without hesitation when a bill transportation passage is disabled due to jamming of a bill or a breakdown.

(A) In one aspect, the present invention provides a fare box comprising a main body, a bill normal receiving opening, a bill normal transportation passage, a bill backup receiving opening, a bill bypass passage, a shutter, and a bill receiving opening switch mechanism. The cashbox is retained in the main body and storing money. The bill normal receiving opening is provided on an outer face of the main body and accepting a bill. The bill normal transportation passage transports the bill accepted at the bill normal receiving opening to the cashbox. The bill backup receiving opening is on an outer face of the main body for accepting a bill. The bill bypass passage that transports the bill accepted at the bill backup receiving opening to the cashbox. The shutter that takes either of two positions selectively, the two positions being a normal position at which the shutter opens the bill normal receiving opening and a bypass position at which the shutter opens the bill backup receiving opening. The bill receiving opening switch mechanism that shifts the position of the shutter to open one of the bill receiving openings.

According to this configuration, not only the bill normal receiving opening but also the bill backup receiving opening are provided as bill receiving openings of the fare box, and either one of these bill receiving openings is selectively opened, or closed by the shutter. Therefore, at the occurrence of jamming of a bill in the bill normal transportation passage, the bill normal receiving opening is closed by the shutter, and the bill backup receiving opening is opened, so that the bill backup receiving opening is used to receive bills. Therefore, even when the bill normal transportation passage is unusable because of a problem such as jamming of a bill having occurred in the bill normal transportation passage, passengers are allowed to continue fare payment with bills. Additionally, when the bill normal transportation passage is unusable, the bill backup receiving opening is opened with the bill normal receiving opening being closed, whereby passengers can immediately notice that the bill normal transportation passage is unusable. This makes it possible to smoothly continue receiving fares paid with bills even when the bill normal transportation passage is unusable.

BRIEF DESCRIPTION OF DRAWINGS

FIG. 2 is a combination of the views showing the fare box of FIG. 1, wherein:

FIG. 2(*a*) is a left side view; FIG. 2(*b*), a front view; FIG. 2(*c*), a right side view; FIG. 2(*d*), a back view; FIG. 2(*e*), a top view; and FIG. 2(*f*), a bottom view.

FIGS. 32(*a*) and 32(*b*) show states of behavior of components on the side of bill passages, wherein: FIG. 32(*a*) is a schematic view thereof in a state where a bill normal-transportation passage is in operation; and FIG. 32(*b*) is a schematic view thereof in a state where a bill bypass passage is in operation.

FIGS. 33(*a*) and 33(*b*) show states of behavior of components on the side of coin passages, wherein: FIG. 33(*a*) is a schematic view thereof in a state where a coin normal transportation passage is in operation; and FIG. 33(*b*) is a schematic view thereof in a state where a coin bypass passage is in operation.

FIG. 35 is a combination of the views showing the fare box according to another example, wherein: FIG. 35(*a*) is a left side view; FIG. 35(*b*), a front view;

FIG. 35(*c*), a right side view; FIG. 35(*d*), a back view; FIG. 35(*e*), a top view; and FIG. 35(*f*), a bottom view.

DETAILED DESCRIPTION OF THE INVENTION

A fare box according to one embodiment of the present invention is described below in accordance with FIGS. 1 to 33(*b*).

<Description of the Fare Box 1>

Figure 1:
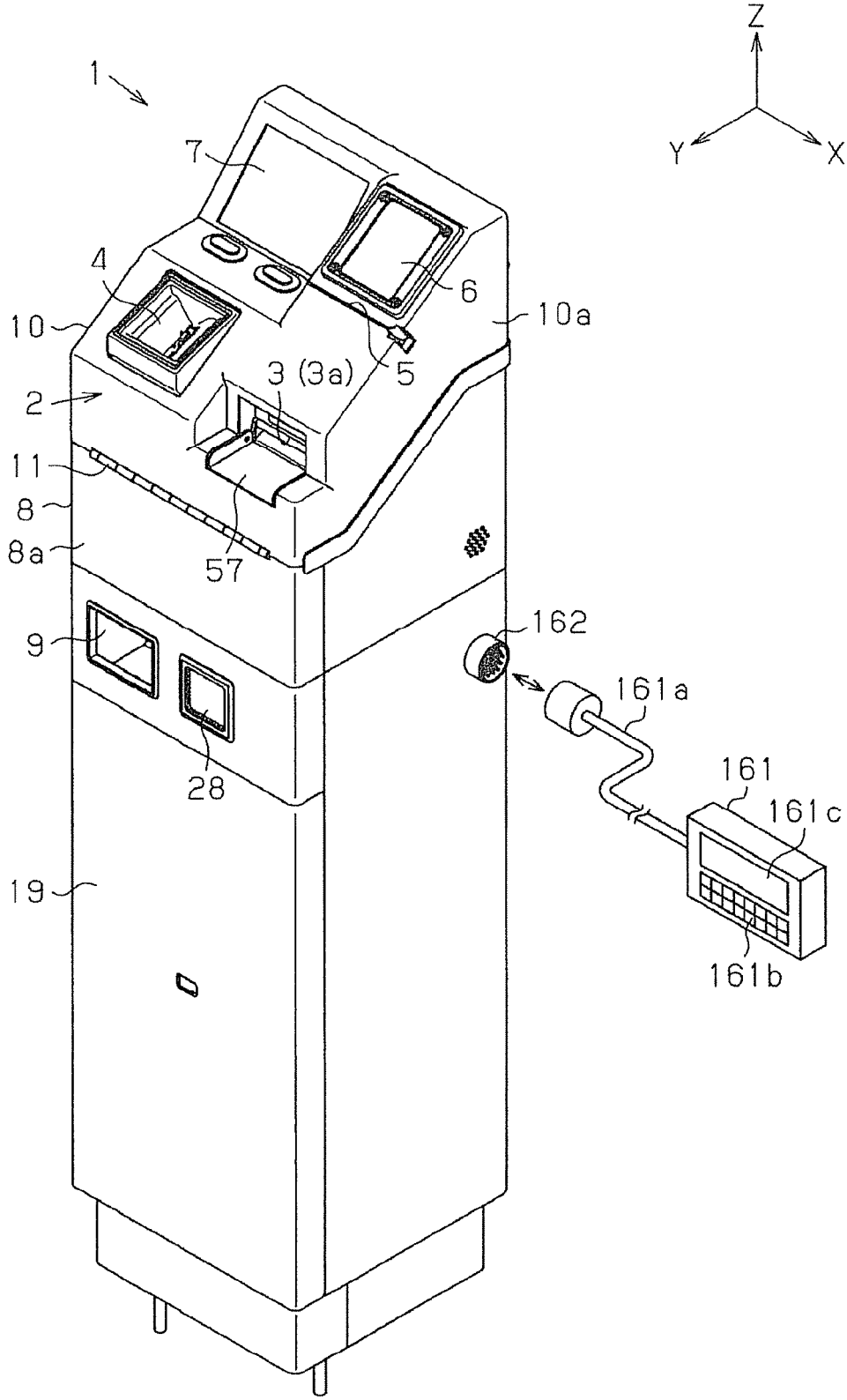
FIG. 1 is a front, top and right side perspective view of a fare box according to one embodiment of the present invention.

First, the overall configuration of the fare box 1 is described. As shown in FIG. 1, a bill acceptor 3, a coin acceptor 4, a magnetic card reader 5, a smart card reader 6 and an operation panel 2 having a passenger-facing display 7 are provided in a front upper portion of the fare box 1. Additionally, a coin return opening 9 and an infrared communication port 28 are provided in a front wall 8*a* of the fare box 1.

Figure 2:
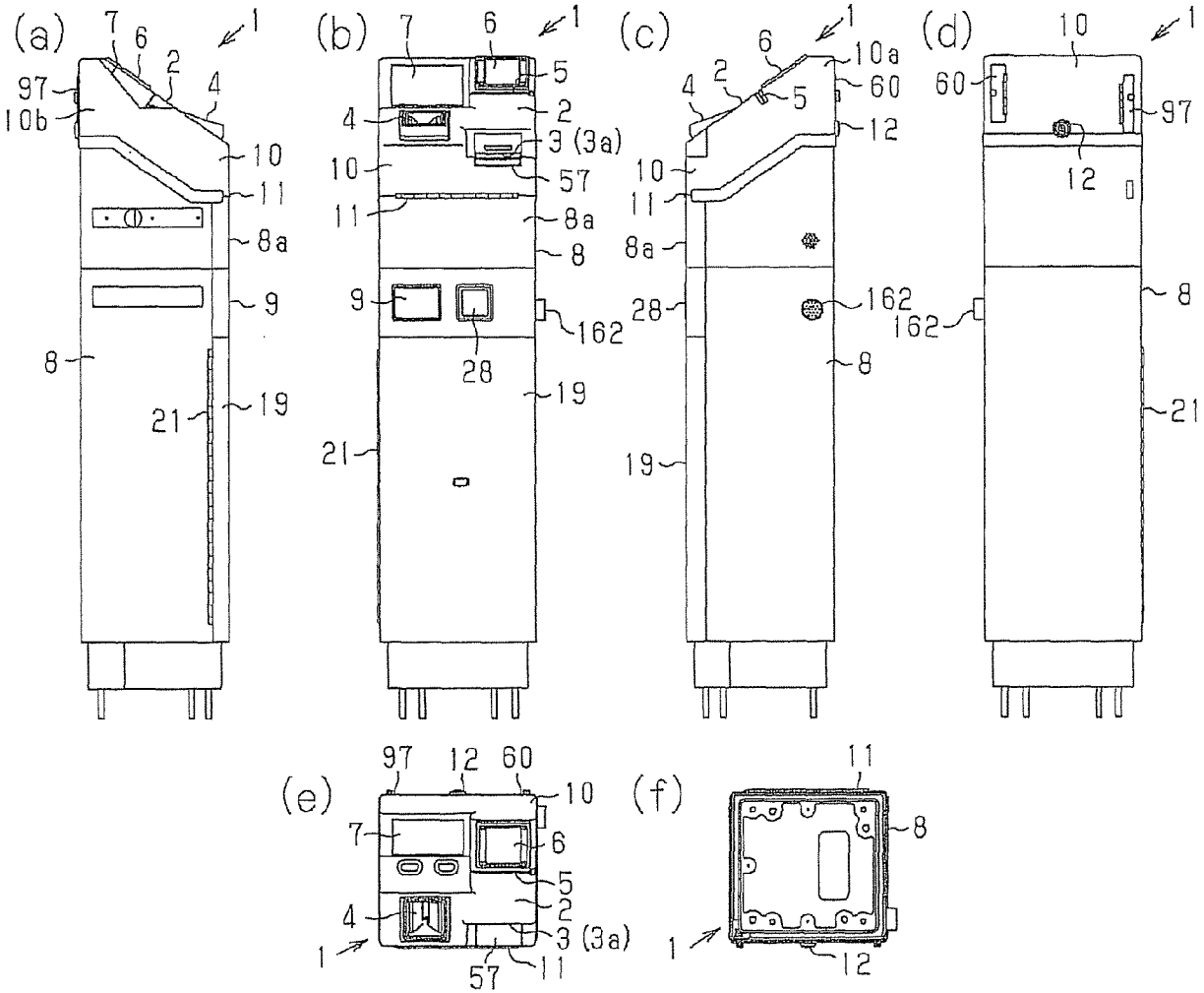

As shown in FIGS. 1 and 2, in the lower part of the operation panel 2, the bill acceptor 3 is provided in one side (the right side in the illustration of the FIG. 1) in the width direction of the fare box (in the X-axis direction in FIG. 1), whereas the coin acceptor 4 is provided in the other side (the left side in the illustration of FIG. 1).

Further, in the upper part of the operation panel 2, the magnetic card reader 5 and the smart card reader 6 are provided in one side in the width direction X of the fare box, whereas the passenger-facing display 7 is provided in the other side. In the fare box 1, the coin return opening 9, through which alien substances, such as a false coin, put into the coin acceptor 4 are ejected, is provided in the front wall 8*a* of a main body 8. Note that the front wall 8*a* corresponds to a wall portion of the present invention.

Figure 3:
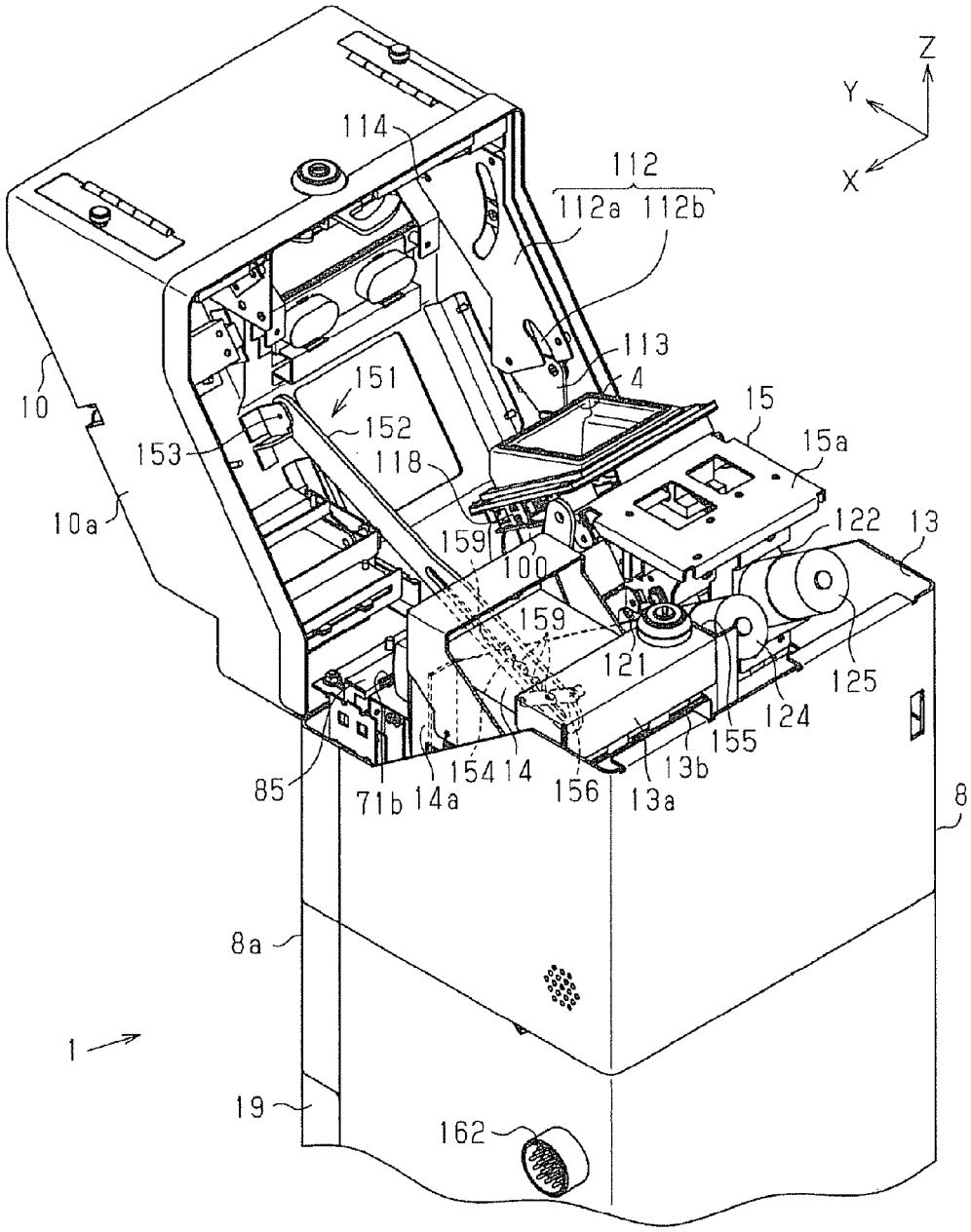
FIG. 3 is a perspective view showing the fare box with a top lid thereof being open.

As shown in FIGS. 1 to 3, an upward-opening top lid 10 having the operation panel 2 is attached to the upper portion of the main body 8 by means of a hinge 11 so as to be selectively openable and closable. The hinge 11 is provided on the front side of the main body 8, and the top lid 10 opens upward by rotating about the front side thereof. The top lid 10 is provided with a cylinder lock 12 capable of locking the top lid 10 while keeping the top lid 10 closed.

Figure 6:
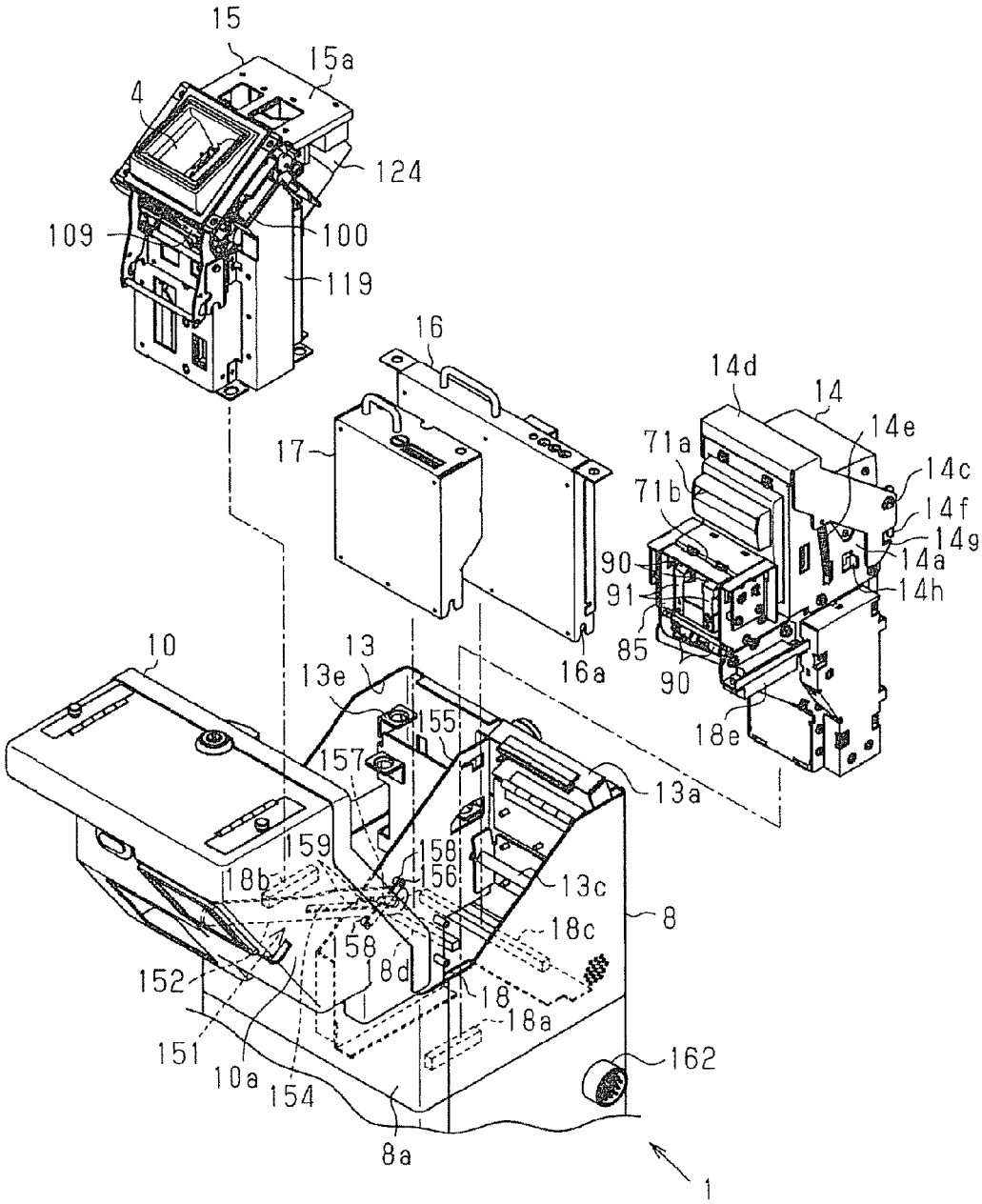
FIG. 6 is a perspective view showing electrical components to be stored in the fare box.

As shown in FIGS. 3 and 6, the inside of the main body 8 is provided with an electrical component storage 13 which opens upward when the top lid 10 is opened. A bill validating module 14, a coin validating module 15, a control module 16, and a power module 17 are stored in the electrical component storage 13. The bill validating module 14 is capable of identifying a bill received from the bill acceptor 3. The coin validating module 15 is capable of identifying a coin received from the coin acceptor 4. The control module 16 controls the fare box 1. The power module 17 controls a power supply of the fare box 1. The bill validating module 14, the coin validating module 15, the control module 16 and the power module 17 are placed so as to line up in a direction along a horizontal plane of the main body 8 (in a direction along the X-Y plane of FIG. 3), and are individually attachable and detachable. Note that the top lid 10 corresponds to a lid of the present invention.

As shown in FIG. 3, in the electrical component storage 13, the entrance of the bill validating module 14 is provided with a locking portion 13*a* to prevent unauthorized detachment of the bill validating module 14. When a cylinder lock is opened with a proper key, the locking portion 13*a* opens upward by means of a hinge 13*b* located on the front side thereof.

As shown in FIG. 6, in the electrical component storage 13, plural connectors 18*a* to 18*d* which are main body side connectors used for connecting the electrical components (the bill validating module 14, the coin validating module 15, control module 16 and the power module 17) are provided in an upward-facing manner. The connectors 18*b* and 18*c* are provided on a relay board 18. Additionally, the connectors 18*a* and 18*d* are provided in the vicinity of the relay board 18, and are electrically connected to the relay board 18 via a harness. The connectors 18*a*, 18*b*, 18*c* and 18*d* are used for the bill validating module 14, the coin validating module 15, the control module 16 and the power module 17, respectively.

Figure 7:
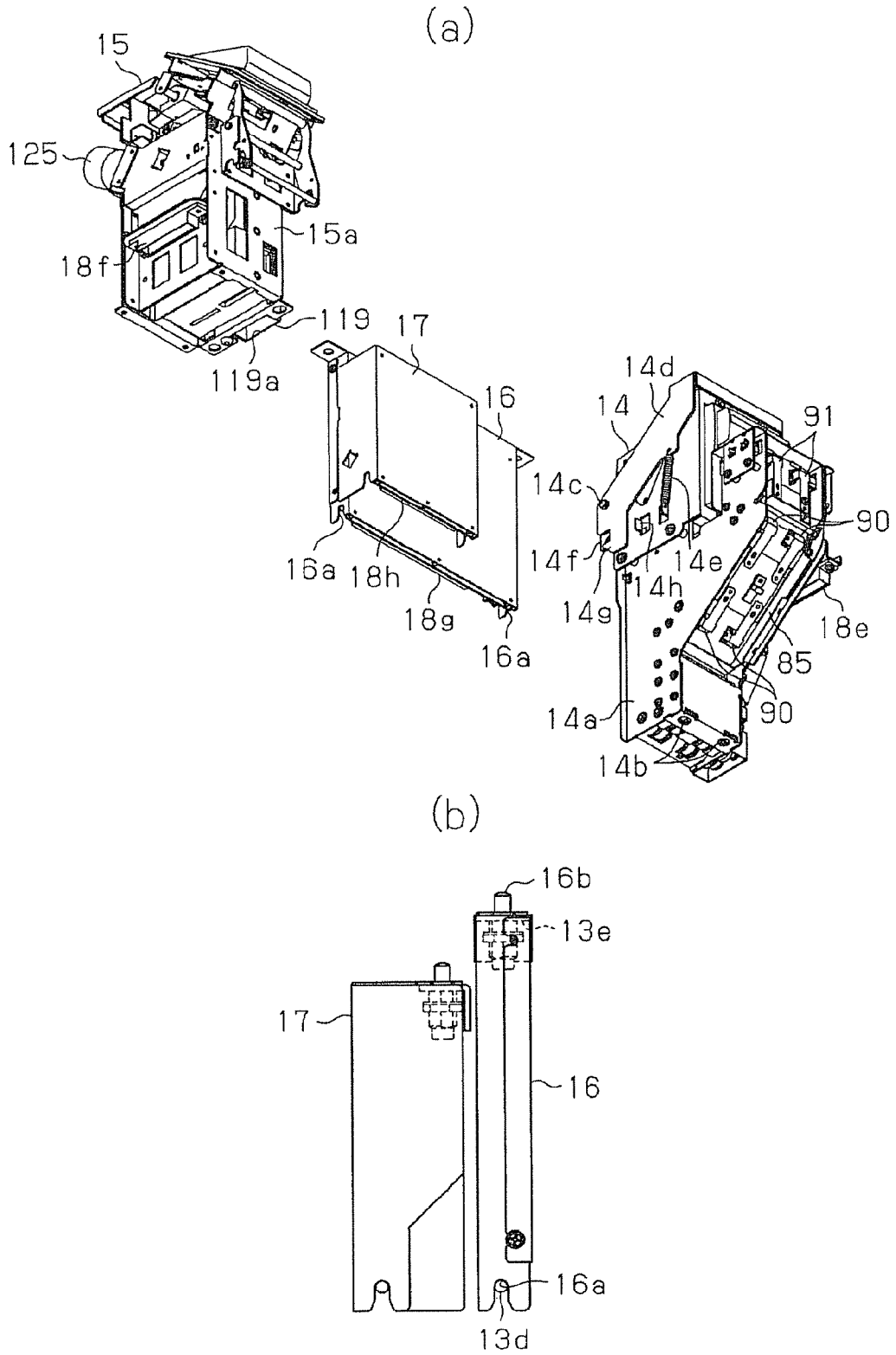
FIG. 7(*a*) is a perspective view of the electrical components viewed from below, whereas FIG. 7(*b*) is a schematic view roughly illustrating a positioning mechanism for a control module and a power module.

As shown in FIGS. 6 and 7(*a*), the bill validating module 14, the coin validating module 15, the control module 16 and the power module 17 comprise device side connectors 18*e* to 18*h* which are provided in a downward-facing manner. In addition, the respective device side connectors 18*e* to 18*h* are connected to the main body side connectors 18*a* to 18*d* that correspond to the respective electrical components.

As shown in FIGS. 6 and 7(*a*), a positioning mechanism is provided between the electrical component storage 13 and the bill validating module 14. The positioning mechanism functions to complete positioning of the bill validating module 14 with respect to the electrical component storage 13 just at the time of storing the bill validating module 14 in the electrical component storage 13. A pair of acceptors 14*b*, 14*b* is on the back side of a module body 14*a* of the bill validating module 14 by making dents therein. Additionally, in the upper part of the module body 14*a*, a handle 14*d* which can be rotated about a shaft 14*c* is provided in a state biased downward by a spring 14*e*. On the back of the module body 14*a*, a pair of shaft acceptors 14*f*, 14*f*, which can be engaged with a lock rod 13*c* provided within the electrical component storage 13 is provided. Additionally, the handle 14*d* comprises a pair of catchers 14*g*, 14*g* to pinch the lock rod 13*c* in cooperation with the shaft acceptors 14*f*, 14*f*.

When the bill validating module 14 is inserted from above into a predetermined position of the electrical component storage 13, a pair of bosses (illustration is omitted) projects on the bottom of the electrical component storage 13 is inserted into the pair of acceptors 14*b*, 14*b*. While the horizontal movement of the bill validating module 14 is thus restricted, the vertical movement of the bill validating module 14 is restricted by hooking the lock rod 13*c* to the shaft acceptors 14*f* and the catchers 14*g*. The bill validating module 14 is thereby positioned in the electrical component storage 13. At the same time as the bill validating module 14 is thus positioned, the main body side connector 18*a* and the device side connector 18*e* are coupled together. When the bill validating module 14 is pulled out from the electrical component storage 13, the catcher 14*g* is set apart from the lock rod 13*c* by pulling up the handle 14*d* and rotating the handle 14*d* until the handle 14*d* abuts on a stopper 14*h*. The main body side connector 18*a* and the device side connector 18*e* are separated from each other by further pulling up the handle 14*d* and thereby lifting the bill validating module 14.

The coin validating module 15 is also provided with a positioning mechanism as in the case of the bill validating module 14. Note that, since the positioning mechanism of the coin validating module 15 is basically the same as that of the bill validating module 14, explanation thereof is not repeated here.

As shown in FIG. 7(*b*), a positioning mechanism is also provided between the electrical component storage 13 and the control module 16. The positioning mechanism completes positioning of the control module 16 with respect to the electrical component storage 13 just at the time of storing the control module 16 in the electrical component storage 13. A pair of recesses 16*a*, 16*a* is provided in a lower portion of the control module 16. Additionally, in the upper portion of the control module 16, a pair of fasteners 16*b*, 16*b* is provided. In the electrical component storage 13, a pair of bosses 13*d* (only one is shown in FIG. 7(*b*)) and support metal fittings 13*e*, 13*e* are provided. Quick release fasteners are used as the fasteners 16*b*, 16*b*. Unlike usual screws, a quick release fastener is a fastener capable of attaching and detaching an object by being rotated substantially a one-quarter turn about the shaft center thereof.

When the control module 16 is inserted from above into a predetermined position of the electrical component storage 13, the pair of recesses 16*a*, 16*a* on the lower portion thereof accepts the bosses 13*d*, 13*d* in the electrical component storage 13, and the horizontal movement of the control module 16 is thereby restricted, whereby the control module 16 is positioned inside the electrical component storage 13. At the same time as the control module 16 is thus positioned, the main body side connectors 18*c* and the device side connector 18*g* are coupled together. Then, the control module 16 is fixed by having the fasteners 16*b*, 16*b* fastened by the support metal fittings 13*e*, 13*e* of the electrical component storage 13. When the control module 16 is pulled out from the electrical component storage 13, an operation for releasing the fasteners 16*b* is performed, whereby the main body side connector 18*c* and the device side connector 18*g* are separated from each other while the control module 16 is pulled upward and lifted up.

The power module 17 is also provided with a positioning mechanism as in the case of the control module 16. Note that, since the positioning mechanism of the power module 17 is basically the same as that of the control module 16, explanation thereof is not repeated here.

These electrical components can be attached to and detached from the electrical component storage 13, and can be easily detached by being pulled upward. Additionally, easy attachment of the electrical components is allowed in such a manner that the thus detached electrical components are returned to the predetermined positions in the electrical component storage 13. Additionally, at the time when the electrical components are positioned in electrical component storage 13 by corresponding positioning members (illustration is omitted), the main body side connectors 18*a* to 18*d* of the respective electrical components directly face corresponding ones of the device side connectors 18*e* to 18*h*, thereby being ready to be coupled thereto. Then, mutually corresponding ones of the connectors are coupled together at the time of storing the electrical components in storage positions.

When each of the electrical components is stored in the electrical component storage 13, the coupling between the corresponding connectors is completed at the same time as the electrical component is put in the storage position as described above. This eliminates the need of coupling devices via a harness as in conventional cases, thereby making it possible to simplify the attachment work.

Additionally, it is easy to individually detach any one of the bill validating module 14, the coin validating module 15, the control module 16 and the power module 17. Therefore, at the occurrence of a trouble such as jamming of a bill or coin, it is possible to take out only the electrical component related to the trouble and perform repair or maintenance work thereon.

Figure 4:
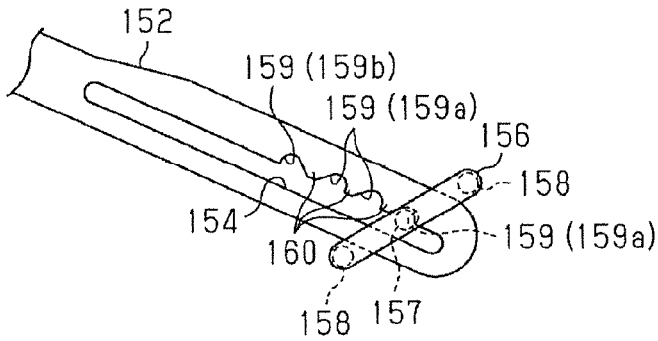
FIG. 4 is a side view showing a top lid stopper mechanism.

As shown in FIG. 3, the top lid 10 is provided with a top lid stopper mechanism 151 to maintain the top lid 10 in an opened state. A long and narrow plate stay 152 is attached to the inner face of the top lid 10 so as to be able to rotate about a shaft 153 provided at the base end of the stay. The stay 152 has a through-hole 154 near the leading end which follows the longitudinal direction of the stay 152 and has one side thereof formed in a wave pattern. A stay joint 156, which supports the stay 152 to allow the stay 152 to slide, is provided on a wall surface of a partition wall 155 in the main body 8. As shown in FIG. 4, the stay joint 156 is provided with: an engaging pin 157 inserted into the through-hole 154; and a pair of projections 158, 158 reinforcing the stay joint 156.

Figure 5:
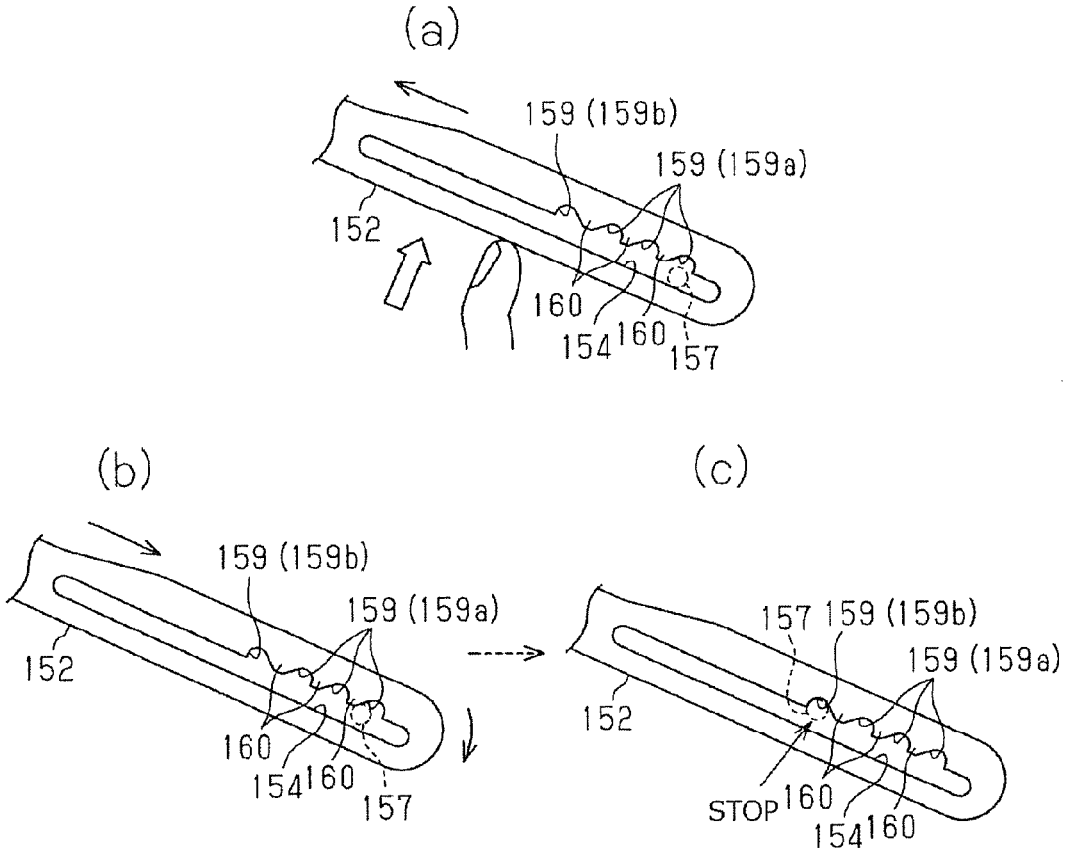
FIGS. 5(*a*) to 5(*c*) are side views showing functioning of the top lid stopper mechanism.

As shown in FIGS. 3 and 4, a plurality of cutout portions 159 are on one side of the through-hole 154 that follows the longitudinal direction, and each part between the cutout portions 159, 159 that are next to each other is formed as a protrusion 160, so that a wave pattern appears. This makes it possible to, when a worker opens the top lid 10 for maintenance, adjust and keep the degree of opening of the top lid 10 in a stepwise manner by stopping the engaging pin 157 in a state selectively engaged with any one of the cutout portions 159. As shown in FIG. 5(*a*), when completely closing the top lid 10, a worker lifts the stay 152 with the fingers to release the engaging pin 157 and the cutout portion 159 from the engagement and allow the stay 152 to slide, and closes the top lid 10.

Among these plural cutout portions 159, 159 in this example, each of cutout portions 159*a*, 159*a* other than a cutout portion 159*b* that is the nearest to the base end is formed in a shape which is more linear by denting in a more gently sloping manner, that is, having the upper face thereof more gently sloping with respect to a horizontal plane.

As shown in FIG. 5(*b*), when the top lid 10 is closed, this configuration causes the top lid 10 to receive a larger force than when moving down only with the own weight thereof, and enables the engaging pin 157 to sequentially slide over and beyond the protrusions 160, 160. This configuration therefore permits the top lid 10 to continuously move down without stopping along the way. The uppermost cutout portion 159*b* is formed in an arc-like shape by denting in a more sharply sloping manner, which is, having the upper face thereof more sharply sloping with respect to a horizontal plane. When the top lid 10 is closed, the engaging pin 157 slides over the cutout portions 159*a*, 159*a* and beyond the protrusions 160, 160, but is caught by the cutout portion 159*b* because the upper face thereof has a shape different from those of the cutout portion 159*a*, 159*a*. Therefore, the engaging pin 157 and the cutout portion 159*b* engage with each other, whereby the top lid 10 stops and is held at a predetermined position before being completely closed. When a worker pushes up with the fingers the engaging pin 157 engaged with the cutout portion 159*b*, the engagement is cancelled, which allows the top lid 10 to be completely closed.

Thus, the top lid stopper mechanism 151 enables adjustment of the degree of opening of the top lid 10. Additionally, stepwise adjustment and determination of the degree of opening of the top lid 10 is enabled by the structure for determining the degree of opening by engaging the engaging pin 157 selectively with any one of the plural cutout portions 159, 159 and so on of the stay 152. Further, when being closed, the top lid 10 can be kept from being completely closed with the engaging pin 157 stopped at this cutout portion 159*b* because the cutout portion 159*b* located nearest to the base end is formed in a shape sloping in such a manner as to prevent the engaging pin 157 from sliding and passing over the cutout portion 159*b*.

As shown in FIG. 1, a control console 161 through which the fare box 1 can be operated from the outside thereof is connectable to the fare box 1. The control console 161 is connected to the fare box 1 when a cable 161*a* extending from the control console 161 is connected with a connector 162 of the sidewall of the main body 8. The control console 161 comprises an input device 161*b* and a display 161*c*. While the fare box 1 is operated with operation of the input device 161*b*, various data transmitted from the fare box 1 is displayed on the display 161*c*.

<Description of a Cashbox Door 19 and a Cashbox 20>

Figure 8:
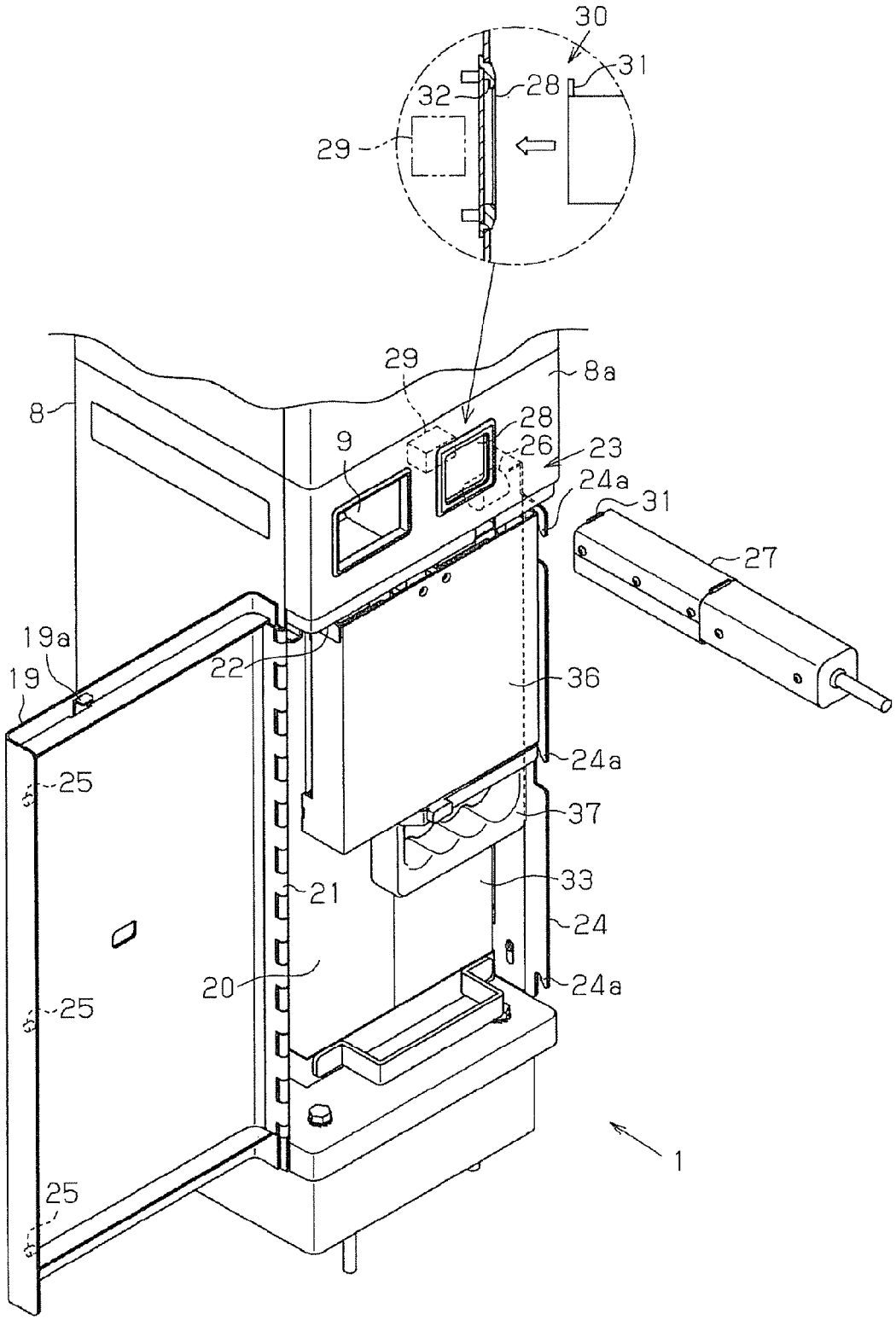
FIG. 8 is a perspective view showing a state where a cashbox is stored.

Then, the configurations of a cashbox door 19 and a cashbox 20 are described. As shown in FIGS. 1 and 8, the cashbox door 19 is attached to the main body 8 with a hinge 21 to be opened or closed selectively. As shown in FIG. 8, a cashbox storage 22 appears on the front side of the main body 8 upon the cashbox door 19 being opened. The cashbox 20 is in a box shape and detachably stored in the cashbox storage 22, and stores money received by the fare box 1. The cash box 20 can be replaced by another cash box in the same shape.

The main body 8 has a cashbox door locking mechanism 23 to lock the cashbox door 19. An engagement plate 24, vertically movable in a height direction Z, is attached to the opening of the cashbox storage 22. A plurality of engagement claws 24*a* lined up in the height direction Z are formed with spaces therebetween on the engagement plate 24. Additionally, a plurality of engagement projections 25 to be engaged with the engagement claws 24*a* are formed on an edge of the cashbox door 19. A motor 26 to cause upward and downward movement of the engagement plate 24 is provided above the engagement plate 24.

An infrared communication port 28 is provided on the front wall 8*a*. The infrared communication port 28 performs infrared communication with a probe 27 used as a key for unlocking the cashbox door 19. The infrared communication port 28 converts an infrared signal received from the probe 27 into an electrical signal, and transmits the electrical signal to a controller 135 (described below) of the control module 16. Additionally, the infrared communication port 28 converts an electrical signal received from the controller 135 into an infrared signal, and transmits the infrared signal to the probe 27. The cashbox door 19 is unlocked on the basis of ID authentication using infrared communication performed between the controller 135 and the probe 27 via the infrared communication port 28.

Between the probe 27 and the infrared communication port 28, a probe hooking mechanism 30 to hang and hook the probe 27 on the infrared communication port 28 is provided. A claw 31 projects on the front end of the probe 27. Additionally, an engagement groove 32 is formed in an upper portion of an edge of the infrared communication port 28. The engagement groove 32 can be engaged with the claw 31 when the probe 27 is in contact with the infrared communication port 28, whereby the probe 27 can be held in a state engaged with the infrared communication port 28 while being in contact therewith.

When the cashbox door 19 is closed, a door detection piece 19*a* is detected by a sensor (not illustrated), and a signal is sent to the controller 135. The controller 135 actuates the motor 26 on the basis of reception of this signal, and the engagement plate 24 is driven downward by the motor 26. As a result, the engagement claws 24*a* are caught by the engagement projections 25, whereby the cashbox door 19 is locked. Additionally, in a state where the cashbox door 19 has been locked, ID authentication using the infrared communication between the probe 27 and the infrared communication port 28 is executed when the probe 27 is set in the infrared communication port 28 with the claw 31 of the probe 27 being hung on the engagement groove 32 of the infrared communication port 28. Then, when this ID authentication successfully ends, the engagement plate 24 is driven upward by the motor 26, and the engagement claws 24*a* are set apart from the engagement projections 25, whereby the cashbox door 19 is unlocked.

Figure 9:
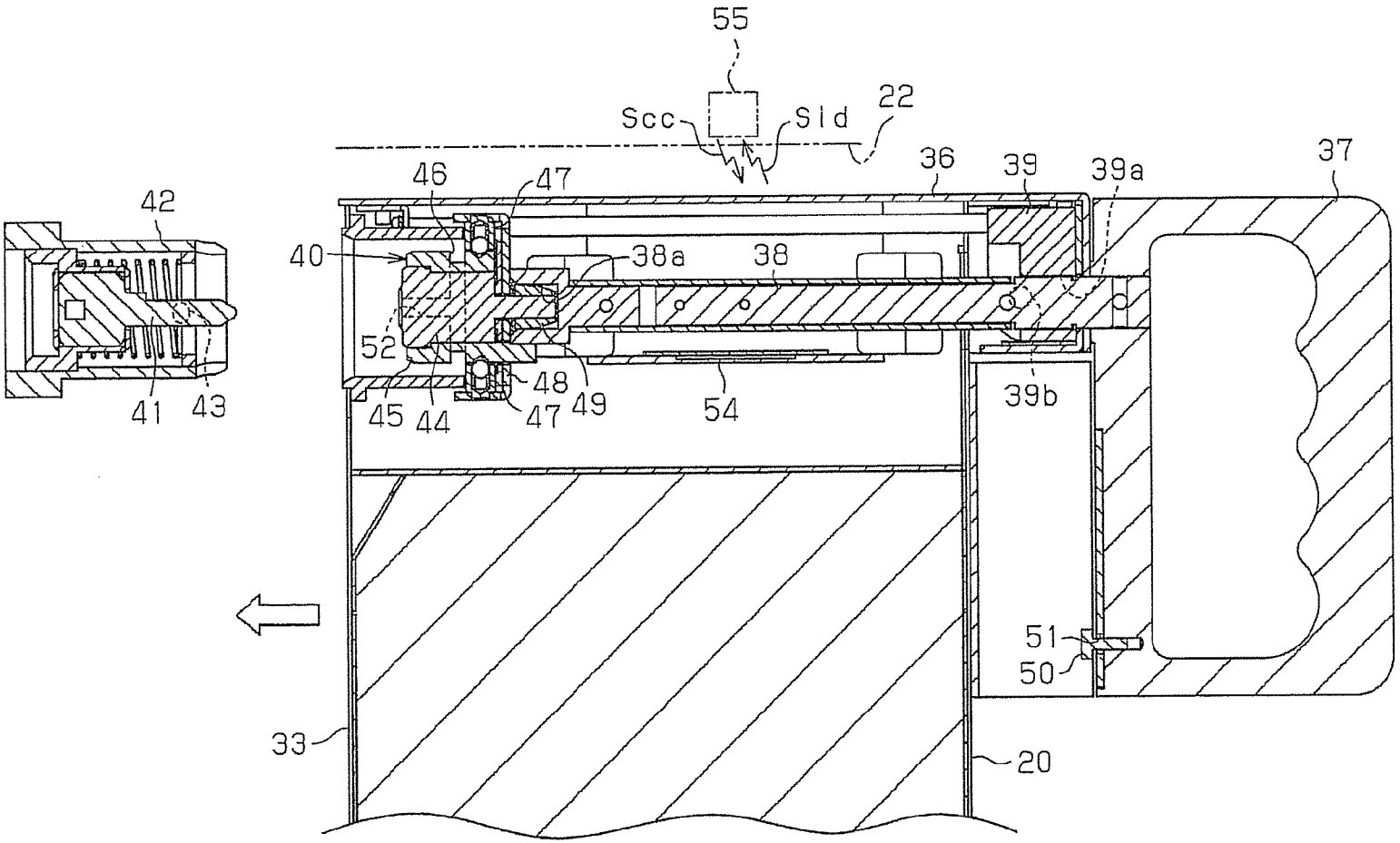
FIG. 9 is a fragmentary cross-sectional view showing the upper part of the cashbox.
Figure 10:
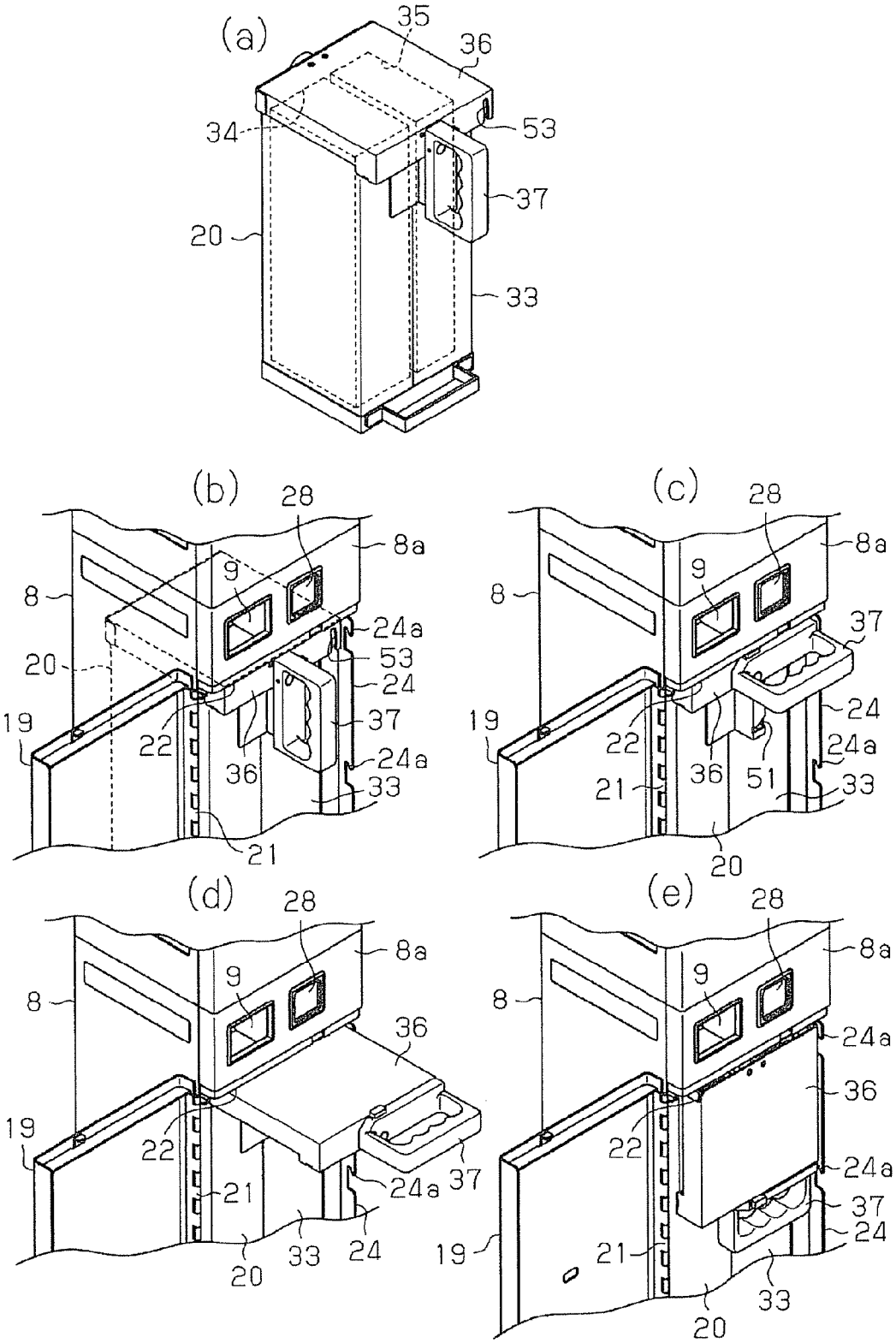
FIGS. 10(*a*) to 10(*e*) are operational illustrations showing a procedure for setting the cashbox in a cashbox storage.

As shown in FIGS. 9 and 10, the cashbox 20 comprises a cashbox body 33 in a box shape with a bottom and storing coins and bills. As shown in FIG. 10(*a*), the inside of the cashbox body 33 is divided into a bill compartment 34 and a coin compartment 35.

As shown in FIG. 9, the cashbox body 33 is provided with a cashbox lid 36 that opens and closes the coin container 35 and the bill container 34 selectively by the cashbox lid 36 laterally sliding. A handle 37 is disposed on one end of the cashbox lid 36. The handle 37 is attached to a shaft 38, and rotatable around the shaft 38. A block 39 with a bearing 39*a* is attached to the cashbox body 33. The shaft 38 is inserted into the bearing 39*a* in such a manner as to be able to slide, and cashbox lid 36, the handle 37 and the shaft 38 can laterally slide together. The top sides of the coin compartment 35 and the bill compartment 34 are opened when the cashbox lid 36 is slid laterally and pulled out from the top side of the cashbox body 33 by pulling the handle 37. The block 39 is provided with a horizontal shaft (not illustrated) perpendicular to the sliding direction of the cashbox lid 36. When being fully pulled out, the cashbox lid 36 is allowed to rotate along with the block 39 about a shaft 39*b* provided in the block 39, whereby it is made possible to put the cashbox lid 36 down, about 90 degrees from the horizontal position.

A cylinder lock 40 is on the back side of the cashbox body 33. A key plate 41, which can be inserted into the cylinder lock 40 of the cashbox 20, is on an inner wall of cashbox storage 22. A pair of tabs 43, 43 (only one of which is illustrated in FIG. 9) projects on the inner face of a support pipe 42 surrounding the key plate 41. Additionally, a rotor case 45, in which a rotor 44 of the cylinder lock 40 is housed, is attached to the outer circumferential surface of the rotor 44 rotatably about the shaft of the rotor 44. An engagement groove 46 which can be engaged with the tab 43, 43 is recessed in the outer circumference of the rotor case 45. The rotor case 45 is pivotally attached to a joint 48 via a pair of moderation members 47, 47. When the cashbox lid 36 is slid to close the cashbox with the handle 37 turned to the side, the shaft 38 slides together with the cashbox lid 36, whereby a shaft engagement 49 is inserted into a recess 38*a* in the tip of the shaft 38. The shaft 38 and the rotor case 45 are thereby engaged with each other, which enables the rotor case 45 and the shaft 38 to rotate together. However, on condition that the key plate 41 is not inserted into the rotor 44, the rotor case 45 is regulated by a key mechanism (not illustrated) to be disabled from rotating about the rotor 44. This key mechanism is conventional mechanism of cylinder locks.

Inserting the key plate 41 into the key hole (illustration is omitted) of the rotor 44 enables the cylinder lock 40 to be unlocked. At this point, the rotor 44 and the key plate 41 are at rest, and the rotor case 45 and the shaft 38 together with the handle 37 rotates about the axis of the shaft 38 when the handle 37 is turned. The cylinder lock 40 is thus locked or unlocked.

As shown in FIGS. 9 and 10(*a*), the cashbox lid 36 is kept closed while the cashbox 20 is unattached to the fare box 1. At this time, the key plate 41 is not in the cylinder lock 40, and the rotor case 45 is disabled from rotating, whereby the handle 37 is in the upright position and disabled from rotating. In other words, while the cashbox 20 is unattached to the fare box 1, the cashbox lid 36 is locked by the cylinder lock 40, which prevents the bill compartment 34 and coin compartment 35 to be opened without authority.

Additionally, as shown in FIG. 9, when the handle 37 is turned clockwise from the horizontal position to the vertical position, an engagement 50 on the back of the handle 37 is engaged with a hook 51 in the front side of the cashbox body 33. In other words, the handle 37 is supported by the cashbox body 33 at two points, the shaft 38 and the engagement 50. The handle 37 is thereby securely supported by the cashbox body 33 when the cashbox 20 is attached to or detached from the cashbox storage 22.

As shown in FIG. 10(*b*), when the cashbox 20 is housed in the cashbox storage 22 while being set in the cashbox storage 22, the key plate 41 is inserted into the cylinder lock 40 of the cashbox 20. At this time, the tabs 43, 43 on the inner face of the support pipe 42 passes through a guide groove 52 on the outer face of the rotor case 45 and reach to the engagement groove 46. Additionally, because the key plate 41 is inserted into the cylinder lock 40, the rotor case 45 and the shaft 38 is allowed to rotate, which allows the handle 37 to be turned. When the handle 37 is turned, the rotor case 45 rotates, which allows the engagement groove 46 and tabs 43 to be engaged with each other and released from each other.

When the handle 37 is in the horizontal position, being turned counterclockwise approximately 90 degrees from the state shown in FIG. 10(*b*), the rotor case 45 (the joint 48) also rotates in conjunction with this turning operation, whereby the cashbox lid 36 is unlocked as shown in FIG. 10(*c*). At this time, the tabs 43, 43 engage with the engaging groove 46 of the rotor case 45, which prevents the cashbox 20 from being pulled out from the cashbox storage 22, whereby the cashbox 20 is locked in the fare box 1. Additionally, the engagement 50 of the handle 37 engages with the hook 51 on an edge of a sidewall of the cashbox lid 36.

As shown in FIG. 10(*d*), after the cashbox lid 36 is unlocked, cashbox lid 36 is pulled out by being slid with the handle 37 being pulled out. Then, as shown in FIG. 10(*e*), after the cashbox lid 36 is fully pulled out, the cashbox lid 36 is brought down, being rotated substantially 90 degrees about the shaft of the block 39. The handle 37 laterally extends and doesn't interfere with the cashbox body 33 when the cashbox lid 36 is brought down.

Therefore, the cashbox 20 is set in the fare box 1 with the cashbox lid 36 opened. The cashbox lid 36 and the handle 37 are brought down to a position in the proximity of a side face of the cashbox body 33, which secure the cashbox lid 36 and the handle 37 not to interfere with the cashbox door 19 when the cashbox door 19 is closed. Description of the removing the cash box 20 is omitted, because the procedure of detaching the cashbox 20 is just a reverse sequence of the procedure mentioned above.

As shown in FIG. 9, a tag 54 that has a unique ID for the cashbox 20 is disposed in the upper portion of the cashbox 20. The tag 54 comprises an antenna, a transmitter and an IC chip although illustration thereof is omitted. The antenna receives radio waves. The transmitter performs radio signal transmission. The IC chip stores the unique ID, and controls the transmitter by operating with the electric power of radio waves received through the antenna. The unique ID stored in the tag 54 is unique to the cashbox 20 the tag 54 is attached to, and this ID differs from unique IDs of other cashboxes of the same shape. Additionally, the body side communicator 55 to perform communication for ID authentication with the tag 54 is provided on the inside of an upper wall of the cashbox storage 22.

When the cashbox 20 is set in the cashbox storage 22, the body side communicator 55 transmits a radio wave Scc to the tag 54. The tag 54 operates by using the radio wave Scc as a power supply, and transmits back an ID code Sid to the body side communicator 55. The body side communicator 55 attempts authentication of the cashbox 20 on the basis of the ID code Sid. Since the authentication on the basis of the ID code Sid is similar to ID code authentication technique used conventionally, description of the details thereof is omitted. The fare box 1 is permitted to operate when the ID code Sid is authenticated as a proper ID code. Note that the tag 54 corresponds to a cashbox side communicator of the present invention, and the body side communicator 55 corresponds to a body side communicator of the present invention.

Because the cashbox 20 is authenticated using short range wireless communication, the fare box 1 can confirm whether a proper cashbox has been attached to the fare box 1. Additionally, the cashbox 20 attached to the fare box 1 is identified with the ID code Sid which is unique to each cashbox. Therefore, when the amount of money inside the cashbox 20 is counted after the cashbox 20 is removed from the fare box 1, it is possible to identify, on the basis of the ID code Sid, the fare box 1 to which the cashbox 20 has been attached, and grasp the amount of money received by the fare box 1.

Additionally, unlike conventional fare boxes, the use of short range wireless communication eliminates the need of an electrical contact between the fare box 1 and the cashbox 20, and a battery in the cashbox 20. Therefore, it requires fewer components to be repaired or replaced on a regular basis than the conventional fare boxes.

Additionally, as for a positional relation between the tag 54 and the body side communicator 55, these components are required only to be close enough to each other and are not required to precisely correspond to each other. Further, it is unlikely to have a trouble in authentication even when dirt adheres to the surfaces of the cashbox 20 and the cashbox storage 22. Therefore, it reduces failures in the authentication of the cashbox.

The tag 54 can be wirelessly written into from the body side communicator 55. The body side communicator 55 writes data into the tag 54 in accordance with a command from the controller 135 (described below) of the control module 16 of the fare box 1. The controller 135 processes monetary data contained in the cashbox 20 based on the monetary data acquired by the bill validating module 14 and the coin validating module 15. Upon detecting the unlocking of the cashbox door locking mechanism 23 by an operation of the probe 27, the controller 135 transmits to the body side communicator 55 a command for writing the amount data. The body side communicator 55 writes the monetary data into the tag 54 via wireless communication. This enables the cashbox 20 to have not only the ID information but also the monetary data.

Note that a flag is set in the tag 54 when the monetary data is written into the tag 54.

Once the cashbox 20 is removed from the fare box 1, until this flag is cleared, operation of the fare box 1 is suspended on the basis of recognition of the flag even if the cashbox 20 is attached again to the fare box 1. An illicit action on the cashbox 20, such as attaching the cashbox 20 again after illicitly taking out money from the cashbox 20, is thereby prevented. Incidentally, the flag set in the tag 54 is reset by using a radio communication unit mounted in a cash collection machine to wirelessly clear the flag, for example, when money in the cashbox 20 is collected by the cash collection machine (illustration is omitted) at the branch.

<Description of the Bill Receiving Opening Switch Mechanism 56>

Figure 11:
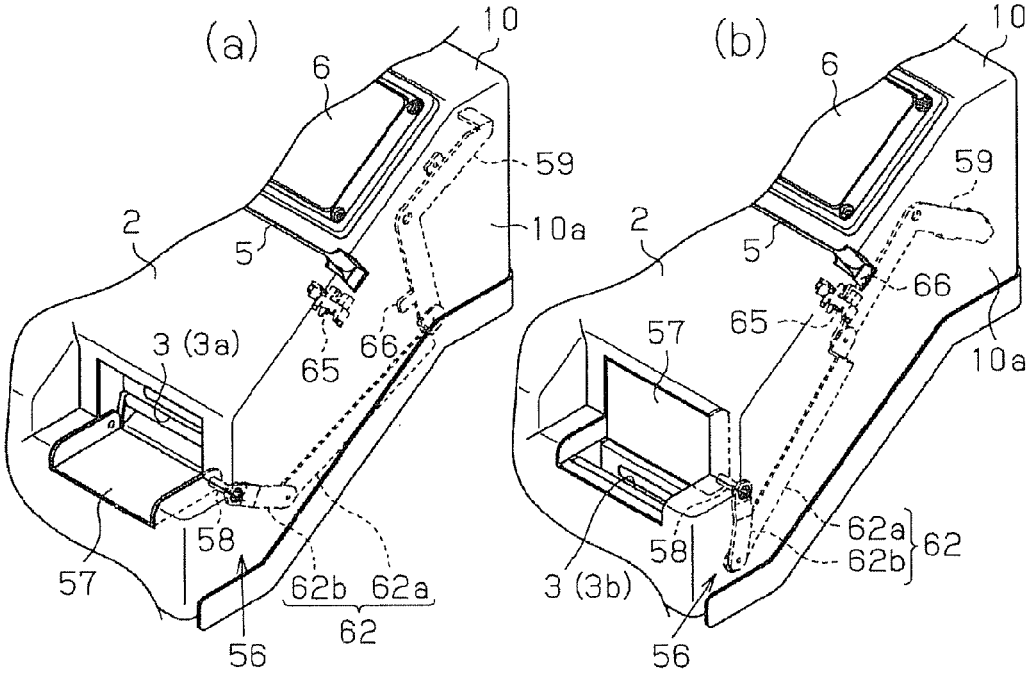
FIG. 11(*a*) is a perspective view of a state where a shutter is placed at a normal position, whereas FIG. 11(*b*) is a perspective view of a state where a shutter is placed at a bypass position.

Next, the configuration of the bill receiving opening switch mechanism 56 is described. As shown in FIGS. 11(*a*) and 11(*b*), the bill acceptor 3 is provided with: a bill normal receiving opening 3*a* used as a bill receiving opening for normal use; and a bill backup receiving opening 3*b* used as a bill backup receiving opening at the occurrence of jamming of a bill in the bill normal receiving opening 3*a*. The bill normal receiving opening 3*a* and the bill backup receiving opening 3*b* are arranged at positions in the proximity of each other in the operation panel 2, and the bill normal receiving opening 3*a* is primarily used.

Figure 12:
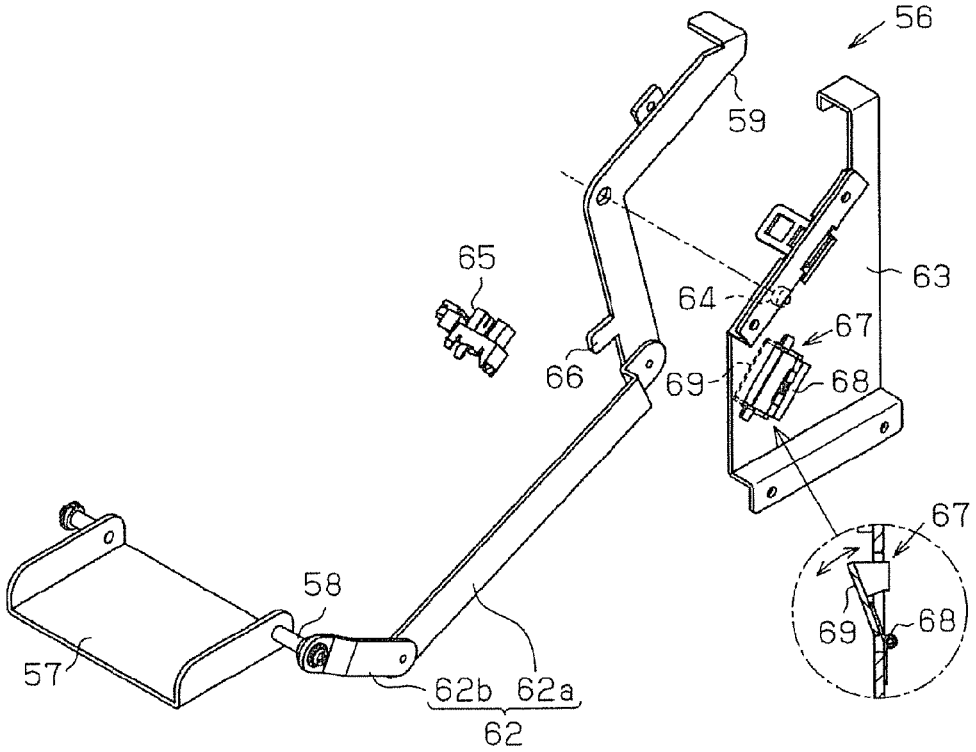
FIG. 12 is an exploded perspective view showing the configuration of a bill receiving opening switch mechanism.
Figure 13:
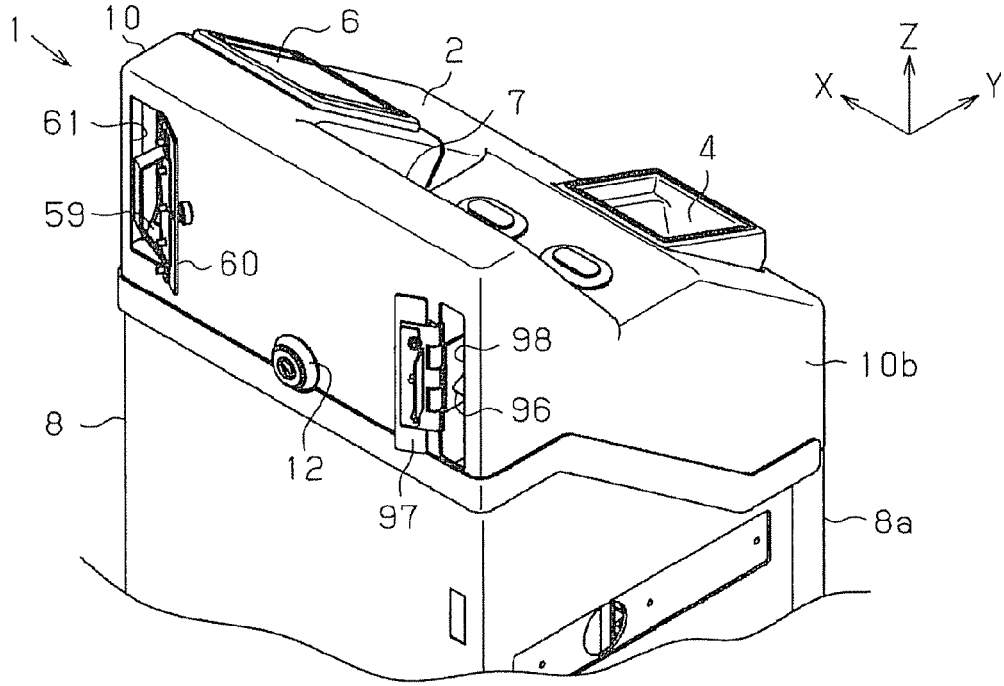
FIG. 13 is a perspective view of the top lid of the fare box, viewed from the back.

As shown in FIGS. 11 to 13, the bill receiving opening 3 is provided with a bill receiving opening switch mechanism 56 to open either one of the bill normal receiving opening 3*a* or the bill backup receiving opening 3*b*, and to block up the other. In this case, a shutter 57 to selectively open either of the bill normal receiving opening 3*a* and the bill backup receiving opening 3*b* is attached to the top lid 10 rotatably about a shaft 58. The shutter 57 has opposing ends across the width direction thereof bent, and appears U-shaped in a cross section viewed from the bill receiving side. The bill normal receiving opening 3*a* and the bill backup receiving opening 3*b*, which are both slit-like, are arranged so as to be substantially parallel to the axis of the shaft 58 which extends along the width direction X.

As shown in FIG. 13, a bill receiving opening switch lever 59 for switching the position of the shutter 57 is provided on the back side of the top lid 10. The bill receiving opening switch lever 59 is stored in a lever case 61 provided with a door 60. The bill receiving opening switch lever 59 is manipulated in the up-and-down manner along the height direction Z. Note that the bill receiving opening switch lever 59 corresponds to a switch controller of the present invention.

Figure 14:
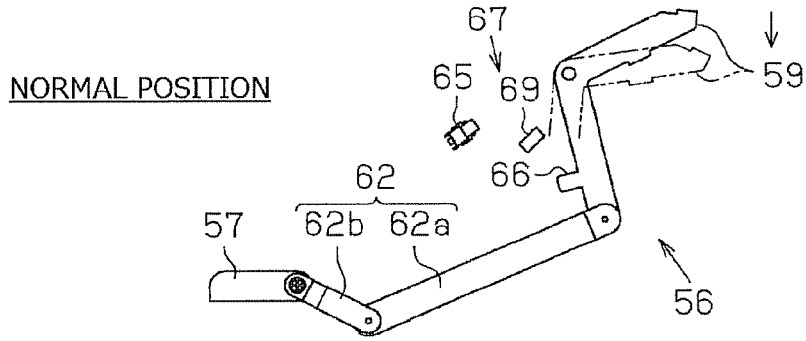
FIG. 14 is a state illustration of a bill receiving opening switch mechanism when the shutter is placed at the normal position.

As shown in FIGS. 11 to 13, the shutter 57 is linked to the bill receiving opening switch lever 59 by a linkage mechanism 62. While a plurality of linkage 62*a* and 62*b*, which are plate-like, are coupled together to constitute the linkage mechanism 62, the linkage mechanism 62 is arranged on the inner face of a sidewall 10*a* of the bill acceptor 3 of the top lid 10. As shown in FIG. 12, the bill receiving opening switch lever 59 is joined to a pivot pin 64 of a stationary plate 63 rotatably, and the stationary plate 63 is attached to the inner face of the sidewall 10*a* of the top lid 10. As shown in FIG. 14, in a state where the bill receiving opening switch lever 59 is raised, the shutter 57 lies down, rotating about the shaft 58, and is placed in a normal position at which the shutter 57 opens the bill normal receiving opening 3*a*. On the other hand, as shown in FIG. 15, when the bill receiving opening switch lever 59 is pulled downward, the shutter 57 stands up, rotating about the shaft 58, is placed in a bypass position at which the shutter 57 opens the bill backup receiving opening 3*b*.

Figure 15:
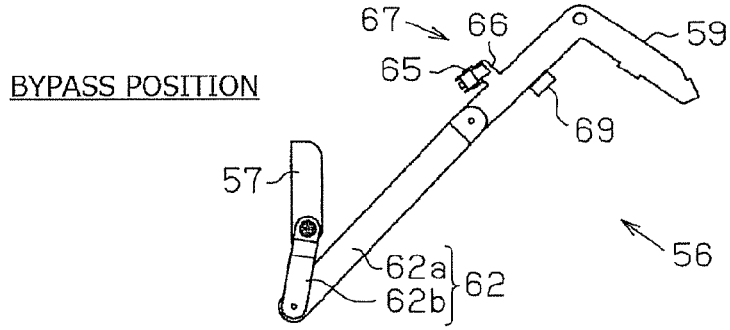
FIG. 15 is a state illustration of the bill receiving opening switch mechanism when the shutter is placed at the bypass position.

As shown in FIGS. 12, 14 and 15, a bill opening switch detection sensor 65 to detect the position of the shutter 57 is attached to the top lid 10. A photo-coupler is used as the switch detection sensor 65. When not detecting a projecting piece 66 of the bill receiving opening switch lever 59, the switch detection sensor 65 outputs an OFF signal for indicating that the shutter 57 is placed in the normal position. When detecting the projecting piece 66, the switch detection sensor 65 outputs an ON signal for indicating that the shutter 57 is placed in the bypass position.

As shown in FIG. 12, the bill receiving opening switch mechanism 56 is provided with a locking mechanism 67 to maintain the shutter 57 at the bypass position. The locking mechanism 67 is composed mainly of the bill receiving opening switch lever 59, the stationary plate 63, a hinge 68 and an engagement 69. The engagement 69 is rotatably attached to the stationary plate 63 via the hinge 68. The engagement 69 is arranged at a position at which the engagement 69 projects toward the bill receiving opening switch lever 59 due to the biasing force of the hinge 68. The position of the engagement 69 relative to the bill receiving opening switch lever 59 is set so as to cause interference therebetween when the bill receiving opening switch lever 59 is moved vertically. When being brought down below, the bill receiving opening switch lever 59 abuts on the inner face side of the engagement 69, and pushes back the engagement 69 against the biasing force of the hinge 68. When the bill receiving opening switch lever 59 has climbed over the engagement 69 after advancing towards the stationary plate 63 while pushing back the engagement 69, the engagement 69 returns to a position at which the engagement 69 projects toward the bill receiving opening switch lever 59 due to the biasing force of the hinge 68. Thereafter, it is impossible to return the bill receiving opening switch lever 59 to the original position despite an attempt to return the bill receiving opening switch lever 59 upward. This is because the bill receiving opening switch lever 59 is caught by the engagement 69, and cannot climb over the engagement 69. The shutter 57 is thereby locked at the bypass position. When the shutter 57 should be returned to the normal position, a person having the authority to manage the key of the top lid 10 opens the top lid 10 by unlocking the key of top lid 10, exposes the inside of the main body 8, and, while pushing the engagement 69 by the hand, returns the bill receiving opening switch lever 59 to the normal position, so that locking of the locking mechanism 67 is cancelled. Note that the locking mechanism 67 corresponds to a locking mechanism and an engagement release mechanism of the present invention.

<Description of the Bill Validating Module 14>

Figure 16:
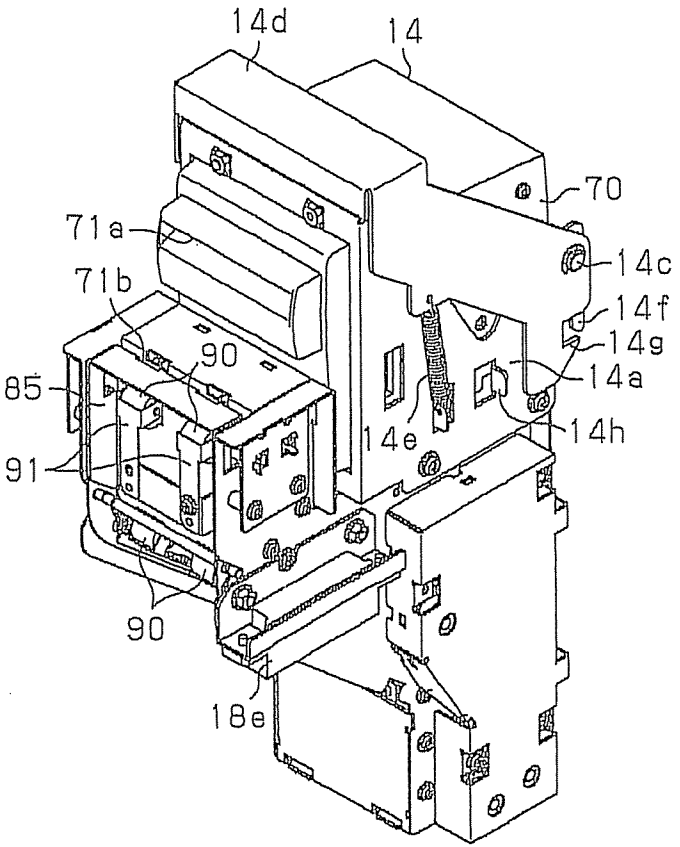
FIG. 16 is a perspective view of a bill validating module viewed from the front.
Figure 17:
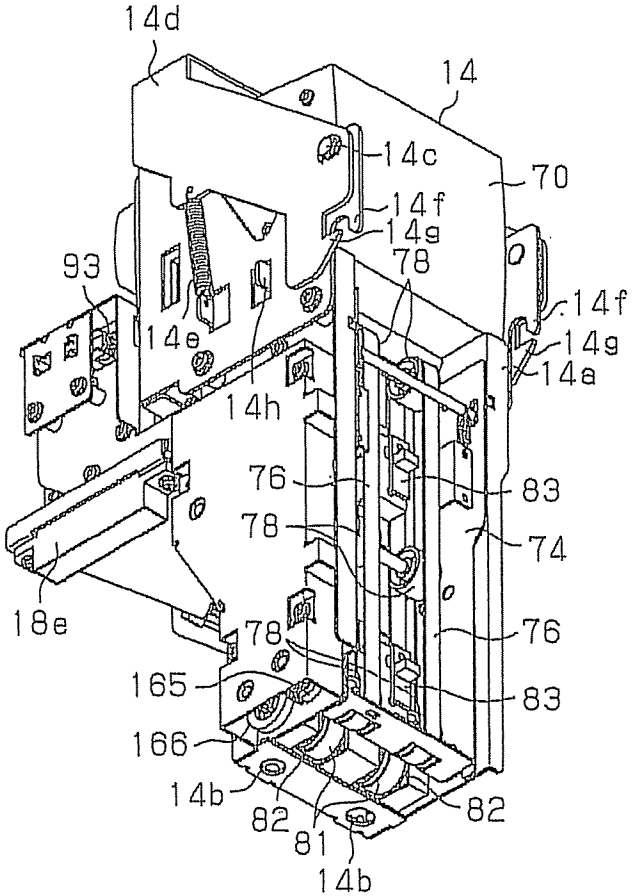
FIG. 17 is a perspective view of the bill validating module viewed from the back.
Figure 18:
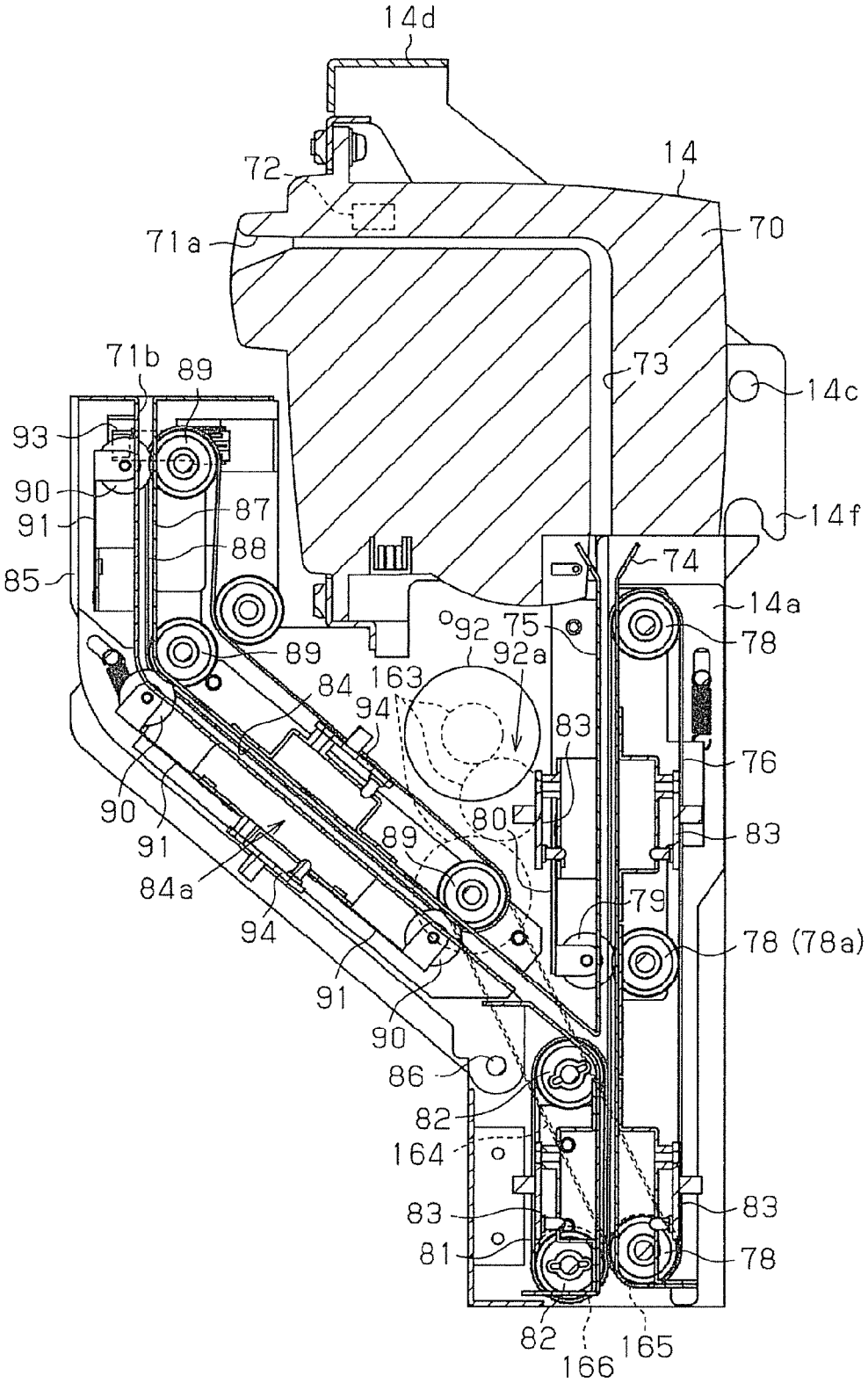
FIG. 18 is a vertical cross-sectional view showing the configuration of the inside of the bill validating module.

Next, the configuration of the bill validating module 14 is described. In the bill validating module 14, a bill validator 70 to identify a bill received from the bill normal receiving opening 3*a* is provided in an upper portion of a module body 14*a* as shown in FIGS. 16 to 18. The bill validator 70 has a bill validator entrance 71*a* opening sideward and receiving a bill inserted into the bill normal receiving opening 3*a*. The bill validator 70 identify the validity and the denomination of the received bill by using a bill validating sensor 72 arranged in the vicinity of the bill validator entrance 71*a*, and transmits the identification result thereof to the controller 135 of the control module 16. Although any one of various bill validators can be used as the bill validator 70, Stackerless Bill Validator manufactured by a Canadian company called Cash-Code Company Inc. is used in this embodiment.

As shown in FIG. 18, a bill normal transportation passage 73 through which a bill received at the bill validator entrance 71*a* passes when being transported to the cashbox 20 is disposed inside the module body 14*a*. The bill normal transportation passage 73 comprises a pair of vertically extending support frameworks 74 and 75.

The outer support framework 74 comprises a pair of transportation belts 76, 76 to draw bills into the inside in the bill normal transportation passage 73. The transportation belts 76, 76 are stretched on plural sets of transportation rollers 78, 78 lined up vertically along the support framework 74. The inner support framework 75 comprises a pair of feed rollers 79, 79, which draws bills into the depths in cooperation with the transportation rollers 78*a* which are located at the center of the sets of transportation rollers. The feed rollers 79, 79 are attached to the support framework 75 via a pair of support pieces 80, 80 which supports the feed rollers 79, 79 in such a manner as to allow the feed rollers 79, 79 to swing. The feed rollers 79, 79 are spaced from the bill validating sensor 72 of the bill validator 70 by a distance larger than the length of each bill. At positions in the lower part of the module body 14*a* that face the trans-portation belts 76, 76, two sets of transportation rollers 82, 82 are provided in such a manner as to vertically line up. Further, the transportation belts 81, 81 are provided in such a manner as to be stretched on the transportation rollers 82, 82.

The bill normal transportation passage 73 comprises plural sets of bill jamming detection sensors 83 in such a manner as to be sandwiched between the bill jamming detection sensors 83 in each of the sets, each of the sets being a pair of optical sensors to detect jamming of a bill in the bill normal transportation passage 73.

A bill bypass entrance 71*b* having an upward opening and receive a bill inserted into the bill backup receiving opening 3*b* is provided in the front upper part of the bill validating module 14. A bill bypass passage 84 through which a bill received by the bill bypass entrance 71*b* passes when being transported to the cashbox 20 is disposed near the front in the inside of the bill validating module 14. The bill bypass entrance 71*b* comprises a bill transportation unit 84*a* to transport to the cashbox 20 a bill inserted into the bill backup receiving opening 3*b*.

Figure 19:
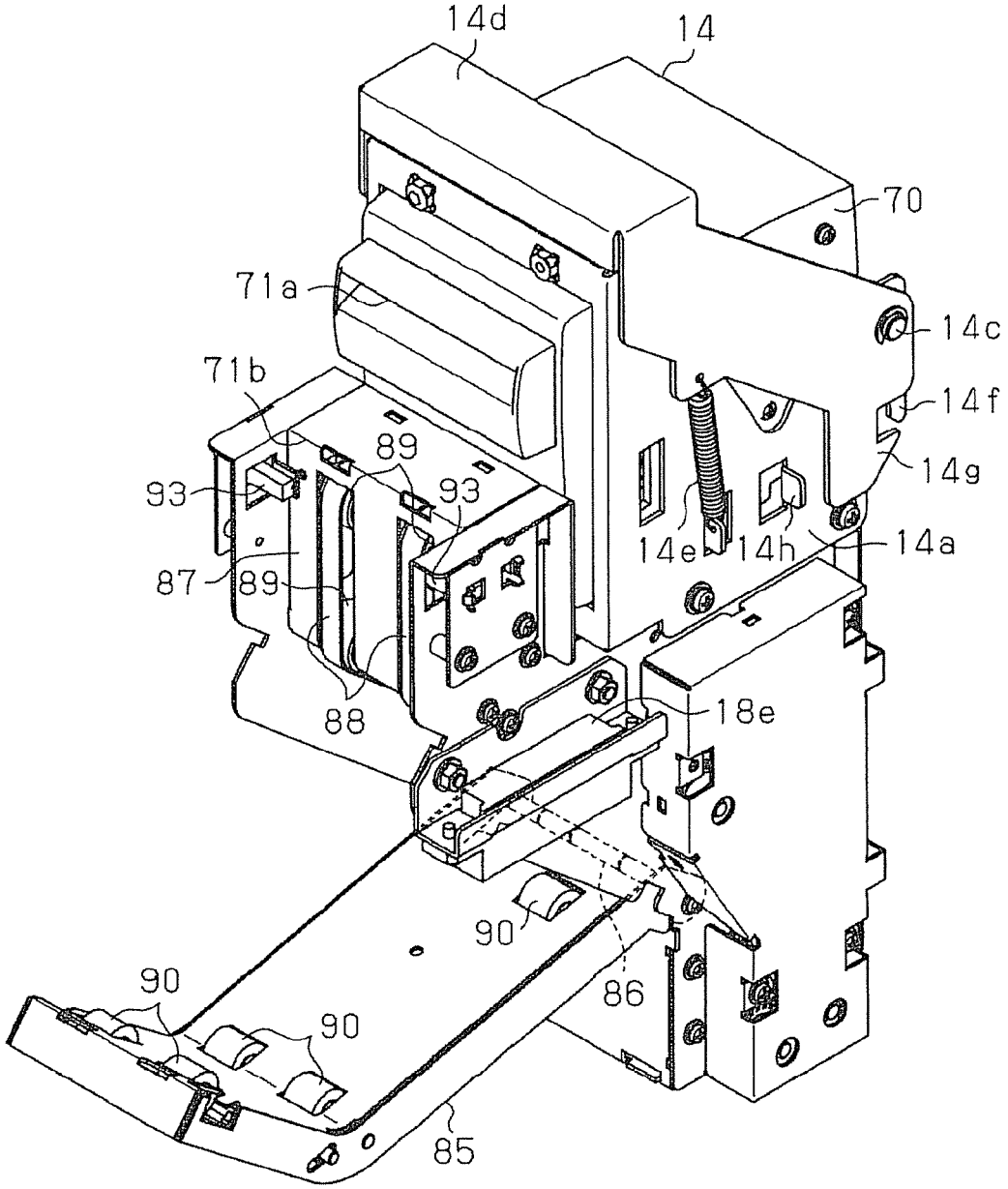
FIG. 19 is a perspective view showing the bill validating module in a state where a movable unit is left open.

As shown in FIG. 19, a movable unit 85 in a shape bent in an intermediate part in a longitudinal cross-sectional view has a lower end thereof joined to a shaft 86 that is provided across the module body 14*a*. The bill bypass passages 84 is formed of a region surrounded by a support wall 87 on the front side of the module body 14*a* and the movable unit 85. The movable unit 85 is supported on the module body 14*a* via the shaft 86 and can be selectively opened or closed, so that the bill bypass passage 84 is exposed by opening the movable unit 85.

As shown in FIG. 18, in accordance with the shape of the movable unit 85 and the support wall 87, the bill bypass passage 84 has a shape of a passage vertically extending straight in the bill bypass entrance 71*b* side and turning in an oblique direction in the middle by bending in an intermediate portion thereof. The bill bypass passage 84 is communicatively connected to the bill normal transportation passage 73 at the lower end, the passage exit, of the passage 84. A bill transported through the bill bypass passages 84 flows into the bill normal transportation passage 73. The bill bypass passage 84 is arranged along the front wall 8*a* of the main body 8 and extends in the height direction Z (vertically).

As shown in FIGS. 18 and 19, the support wall 87 comprises a pair of transportation belts 88, 88 to draw a bill into the inside in the bill bypass passages 84. The transportation belts 88, 88 are stretched on transportation rollers 89, 89 each two of which constitute one set. The movable unit 85 comprises plural sets of feed rollers 90, 90 each two of which constitute one set and are disposed in such a manner as to correspond to the transportation rollers 89, 89, and the transportation rollers 89, 89 and the rollers 90, 90 cooperate together to transport a bill. These feed rollers 90, 90 are attached to the movable unit 85 via pairs of support pieces 91, 91 supporting the feed rollers 90, 90.

The module body 14*a* comprises a motor 92 to serve as a drive source for the transportation belts 76, 81 and 88. The motor 92 is linked to each of the transportation rollers 78, 82 and 89 by a mechanical-power transmission 92*a* such as gears, pulleys or belts, and transmits mechanical power to each of the transportation belts. More specifically, the motor 92 is linked by a group of gears 163 and a belt 164 to a drive gear 165 joined to an axial end of the transportation rollers 78, 78. Further, the drive gear 165 is meshed with a driven gear 166 joined to an axial end of the transportation rollers 82, 82.

In this embodiment, the bill normal receiving opening 3*a* and the bill backup receiving opening 3*b* are prepared in a bill acceptor 3, and either of these openings is selectively opened by the shutter 57 of the bill receiving opening switch mechanism 56. This makes it possible to, at the occurrence of jamming of a bill in the bill normal transportation passage 73, continue receiving bills by causing the shutter 57 rotate to the bypass position from the normal position at which the shutter 57 has been located so far, and thereby bringing the bill backup receiving opening 3*b*, instead of the bill normal receiving opening 3*a*, into operation. Additionally, at this time, the bill normal receiving opening 3*a* is closed by the shutter 57, whereby it can be immediately understood that the bill backup receiving opening 3*b* must be used. Therefore, it is also made possible to smoothly continue receiving bills after the occurrence of jamming of a bill.

As shown in FIGS. 18 and 19, bill determination sensors 93 to determine the size of a bill, which is received by the bill bypass entrance 71*b*, in the width direction thereof are attached to the bill bypass entrance 71*b*. The bill determination sensors 93 are optical sensors, and are provided in a pair at opposing sides of an opening of the bill bypass entrance 71*b* while being spaced from each other by a distance larger than the width of a magnetic card of a common size, and detect whether a width dimension of an inserted ticket or the like is larger than a gap between the bill determination sensors 93. The controller 135 controls drive of the motor 92 on the basis of a detection result of the bill determination sensor 93. This makes it possible to, when a magnetic card has been mistakenly inserted, stop the motor 92 by determining the card is not a bill because of a width dimension thereof smaller than a bill, and thereby prevent the magnetic card from being taken into the inside of the fare box 1. Additionally, the bill bypass passages 84 is also provided with plural bill jamming detection sensors 94 each of which is similar to each of the above mentioned bill jamming detection sensors 83. Note that the bill determination sensors 93 correspond to a bill detector of the present invention, and the controller 135 corresponds to a bill determination section of the present invention.

In this embodiment, the structure of the bill receiving opening switch mechanism 56 can be simplified because the bill receiving opening switch mechanism 56 is manually operated.

When the shutter 57 is set at the bypass position by the bill receiving opening switch mechanism 56, the shutter 57 is locked by the locking mechanism 67. Therefore, after the bill bypass passage 84 is put into operation, it is impossible to return the shutter 57 to the normal position by operating the bill receiving opening switch lever 59. This makes it possible to reduce a risk of having a bill inserted in the bill normal transportation passage 73 at the occurrence of jamming of a bill therein.

The locking mechanism 67 of the bill receiving opening switch mechanism 56 is arranged inside the top lid 10, which makes it impossible to return the shutter 57 located at the bypass position to the normal position unless the top lid 10 is opened by unlocking the cylinder lock 12 of the top lid 10. This prevents unauthorized and illicit use of the locking mechanism 67.

The linkage mechanism 62 of the bill receiving opening switch mechanism 56 is arranged along the inner face of the sidewall 10*a* of the top lid 10. Therefore, a large space is left inside the top lid 10 for constituting members of the bill receiving opening switch mechanism 56.

The bill bypass entrance 71*b* is provided with the bill determination sensors 93, and bills are received by the bill bypass passage 84 only when these bill determination sensors 93 have determined an inserted object to be a bill. This prevents pieces of paper and magnetic cards that are narrower than bills from being taken into the bill bypass passages 84.

The bill bypass passage 84 is arranged along the front wall 8*a* of the main body 8, the bill bypass passage 84 is located near an inside surface of the main body 8. This enlarges the electrical component storage 13 in the main body 8. Additionally, the cashbox 20 is arranged under the bill bypass passage 84, whereby, when a bill is transported to the cashbox 20 from the bill bypass passages 84, the bill can be transported to the cashbox 20 through a simple route sending a bill downward from above. This makes it less likely to have the bill bypass passages 84 jammed with a bill.

<Description of a Coin Transportation Passage Switch Mechanism 95>

Next, the configuration of a coin transportation passage switch mechanism 95 is described. As shown in FIG. 13, a coin transportation passage switch lever 96 used for switching coin transportation passages is provided in the back side of the top lid 10.

The coin transportation passage switch lever 96 is stored in the lever case 98 having a door 97. The coin transportation passage switch lever 96 is operated by being moved along the height direction Z.

Figure 20:
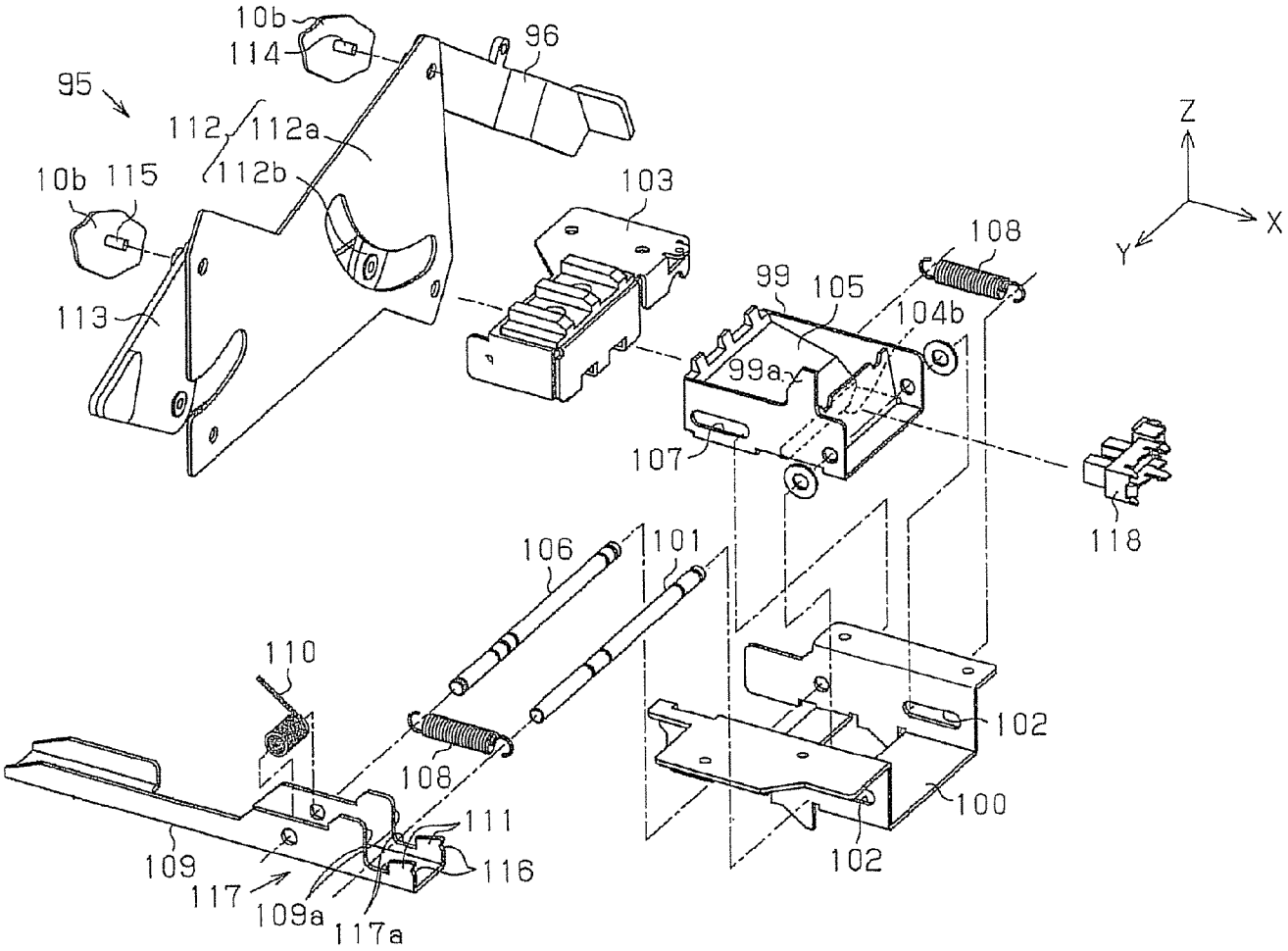
FIG. 20 is an exploded perspective view showing the configuration of a coin transportation passage switch mechanism.
Figure 21:
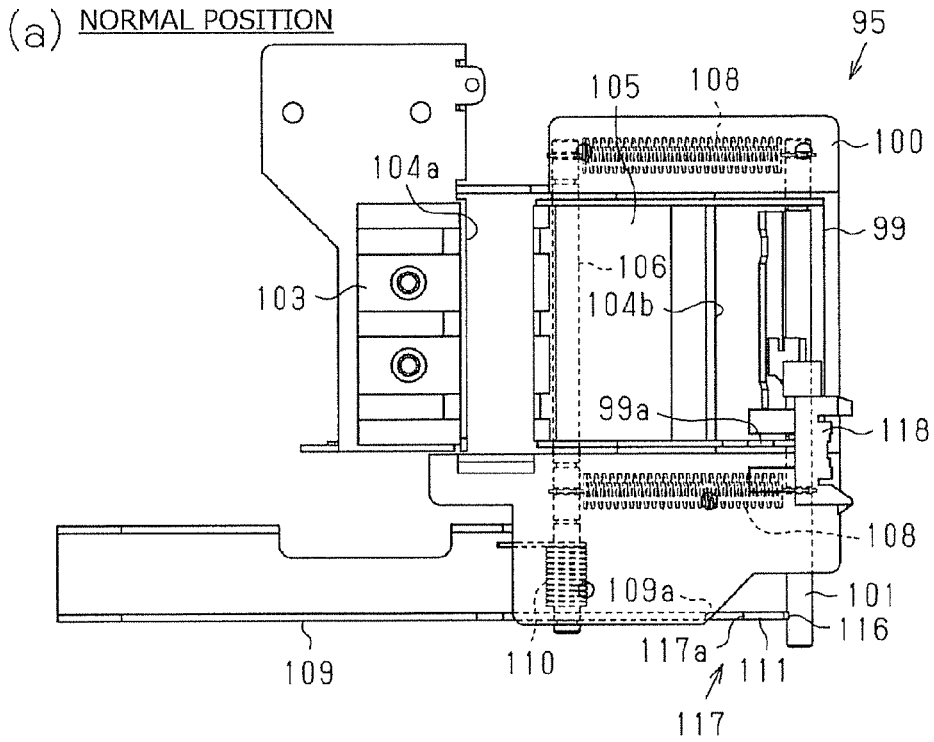
FIG. 21(*a*) is a state illustration of the coin transportation passage switch mechanism when a valve member is placed at a normal position, whereas FIG. 21(*b*) is a state illustration of the coin transportation passage switch mechanism when the valve member is placed at a bypass position.
Figure 21:
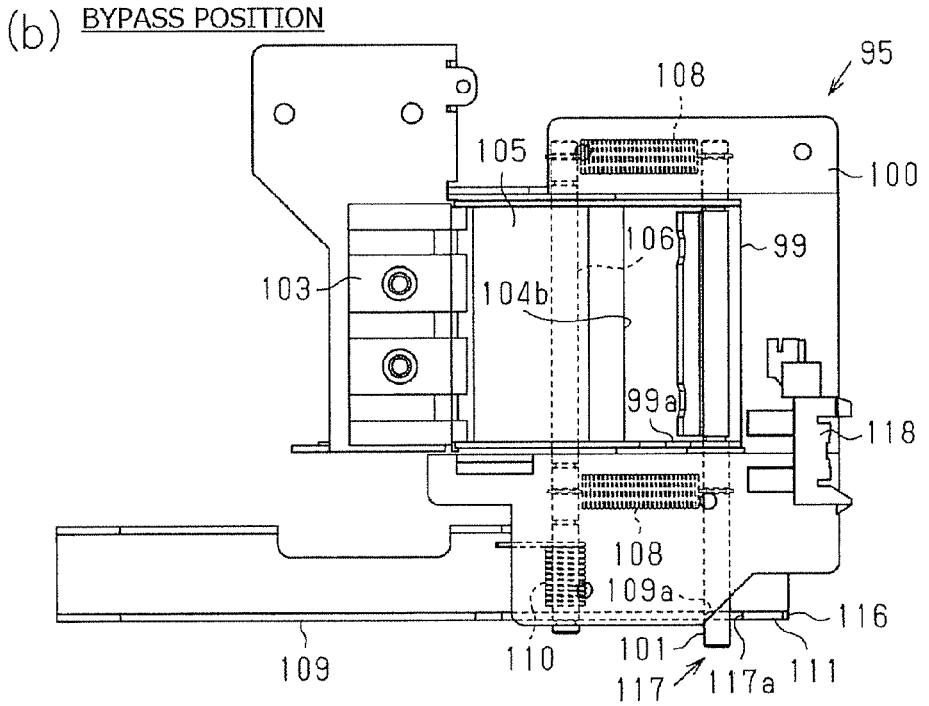
Figure 22:
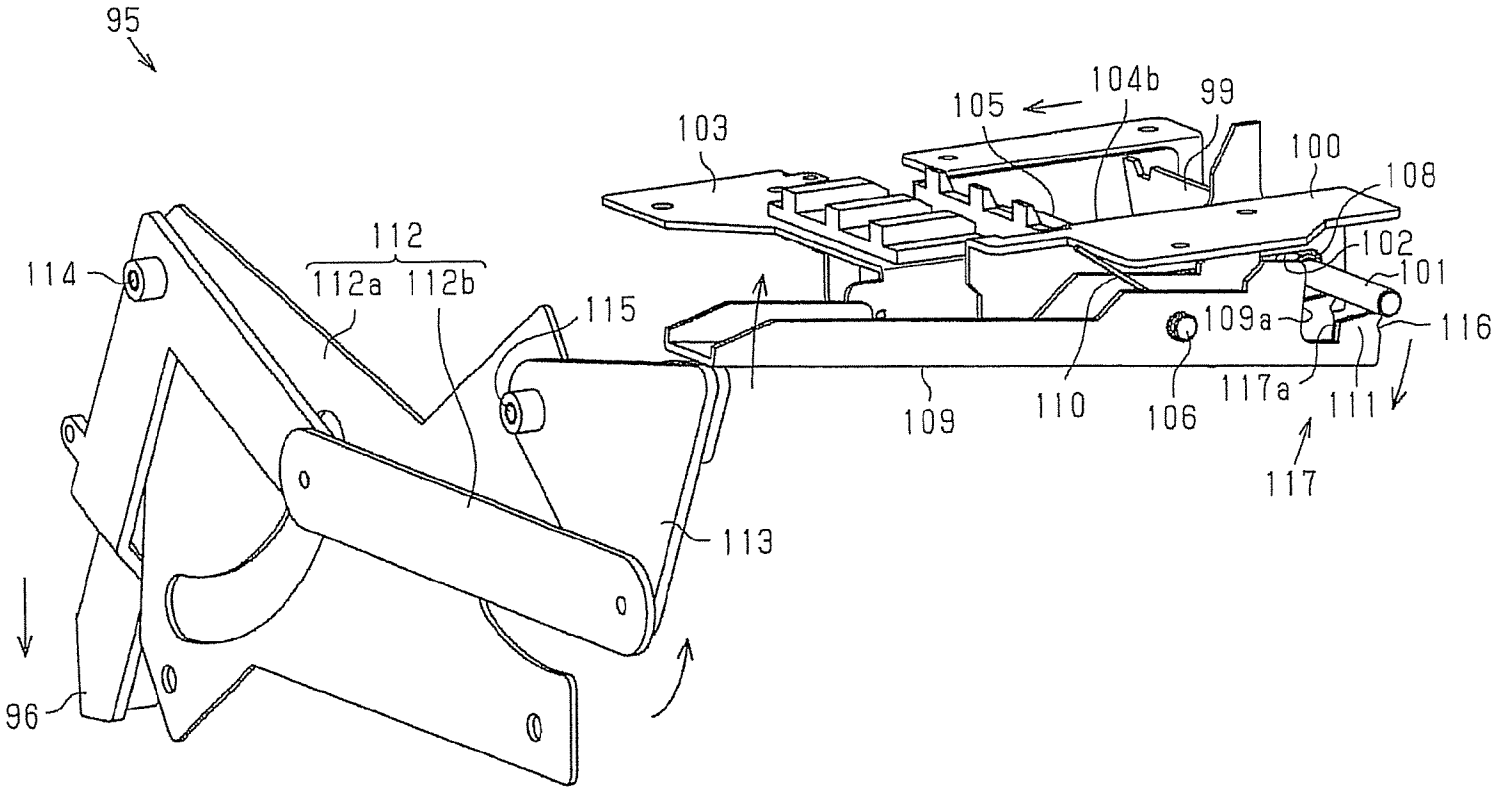
FIG. 22 is a behavior illustration showing behavior of the coin transportation passage switch mechanism.

As shown in FIGS. 20 to 22, a module body 15*a* of the coin validating module 15 comprises a seat 100 supporting a valve member 99 so that the valve member 99 can slide in the direction X (the width direction) which intersects a direction along which coins fall. The valve member 99 is switches the destination of the coin.

A support shaft 101 extending in the depth direction is fixedly attached to an end of the valve member 99, and the support shaft 101 is inserted through a pair of long holes 102, 102 formed so as to penetrate the seat 100. Each of the long holes 102 is a laterally long hole. The support shaft 101 can slide in the direction X by being guided by the long holes 102.

The seat 100 comprises a fixed shaft 106 parallel to the support shaft 101. The fixed shaft 106 is inserted through a long hole 107 in the valve member 99, and the fixed shaft 106 can slide in the direction X by following the longitudinal direction of the long hole 107.

Therefore, the valve member 99 is allowed to slide in the direction X with the support shaft 101 guided by the long holes 102, 102 and the fixed shaft 106 guided by the long hole 107.

A coin guiding part 103, which forms a coin transportation passage combined with the valve member 99, is provided at a position facing the valve member 99. A gap between the valve member 99 and the coin guiding part 103 forms a normal coin entrance 104*a* into which coins are put at normal times. In the valve member 99, a backup coin entrance 104*b* is penetratingly formed as a backup to be used when the normal coin entrance 104*a* is unusable. The valve member 99 has a slope 105 on the top surface thereof for the purpose of making it easy for a coin thereon to slide down into the backup coin entrance 104*b*. A pair of biasing members 108, 108 to constantly bias the valve member 99 in such a direction that the valve member 99 is drawn near to the coin guiding part 103 is provided across the support shaft 101 and the fixed shaft 106. Each of the biasing members 108 is a coil spring.

A lever 109 to position the valve member 99 is joined to the fixed shaft 106 in such a manner as to be rotatable about the fixed shaft 106. The fixed shaft 106 is provided with a return biasing member 110 to constantly bias the lever 109 in such a direction that the lever 109 is raised (counterclockwise from the viewpoint of FIG. 20). The return biasing member 110 is a torsion spring. A pair of projecting pieces 111, 111 projects in the leading end of the lever 109.

As shown in FIGS. 20 and 22, the coin transportation passage switch lever 96 is linked to a lever pushing-up piece 113 by a linkage mechanism 112. The linkage mechanism 112 is composed of a plate linkage 112*a* and a rod linkage 112*b*, and is arranged along and in the close proximity of the inner face of a sidewall 10*b* in one side of the top lid 10 that faces the coin acceptor 4. The coin transportation passage switch lever 96 and the linkage 112*a* are joined to a pivot pin 114 on the inner face of the sidewall 10*b* so as to be rotatable. Additionally, the lever pushing-up piece 113 is in a triangular plate, and a corner portion thereof is joined to a pivot pin 115 on the inner face of the sidewall 10*b* so as to be rotatable. When the coin transportation passage switch lever 96 is brought down below, the lever pushing-up piece 113 pushes up the lever 109 by abutting on the bottom end of the lever 109 from below, and causes the lever 109 to rotate about the fixed shaft 106 in such a direction that the lever 109 is raised.

As shown in FIG. 21(*a*), the support shaft 101 and a pair of engagement recesses 116, which are formed in the front end of the lever 109, are engaged with each other when the support shaft 101 abuts on the engagement recesses 116 and is pressed against the engagement recesses 116 by the biasing forces of the biasing members 108, 108. At this time, the valve member 99 is separated from the coin guiding part 103 and placed at the normal position at which the valve member 99 opens the normal coin entrance 104*a*. On the other hand, as shown in FIG. 22, the bottom end side of the lever 109 is pushed up by the lever pushing-up piece 113, so that the lever 109 to rotate about the fixed shaft 106. When the support shaft 101 and the engagement recesses 116 are released from the engagement, the valve member 99 slides due to the biasing forces of the biasing members 108 in such a direction as to approach the coin guiding part 103, and then stops by abutting on a regulation edge 109*a* of the lever 109. At this time, as shown in FIG. 21(*b*), the valve member 99 is placed at the bypass position at which the valve member 99 closes the normal coin entrance 104*a* and opens the backup coin entrance 104*b*. The backup coin entrance 104*b* is located in the lower side of the slope 105, whereby a coin put on the valve member 99 is guided to the backup coin entrance 104*b* by sliding down in accordance with the incline of the slope 105.

As shown in FIGS. 20 to 22, the coin transportation passage switch mechanism 95 is provided with a locking mechanism 117 to maintain the valve member 99 at the bypass position. As shown in FIG. 21(*b*), when the operation of the coin transportation passage switch lever 96 is cancelled while the valve member 99 is located at the bypass position, the locking mechanism 117 works in such a manner that the lever 109 retunes to the original position thereof by rotating while pushing back the lever pushing-up piece 113 due to the biasing force of the return biasing member 110. At this time, the regulation edge 109*a* and the support shaft 101 slide in contact with each other, and the support shaft 101 is caught by a pair of regulation grooves 117*a*, 117*a* of the lever 109, whereby the valve member 99 is maintained at the bypass position. After the support shaft 101 is caught by the regulation grooves 117*a*, it is impossible to return the valve member 99 to the normal position only by manipulating the coin transportation passage switch lever 96. Unlocking the locking mechanism 117 in a locked state is possible by unlocking and opening the top lid 10, rotating the lever 109 by the hand from the inside, returning the valve member 99 to the normal position and returning the support shaft 101 to a state caught by the engagement recesses 116.

The module body 15*a* is provided with coin passage switch detection sensor 118 to detect the position of the valve member 99. The coin passage switch detection sensor 118 is a photo-coupler. The coin passage switch detection sensor 118 detects a projecting piece 99*a* of the valve member 99 and outputs an ON signal when the valve member 99 is at the normal position. On the other hand, when valve member 99 is placed at the bypass position, the coin passage switch detection sensor 118 does not detect the projecting piece 99*a* and outputs an OFF signal.

Figure 24:
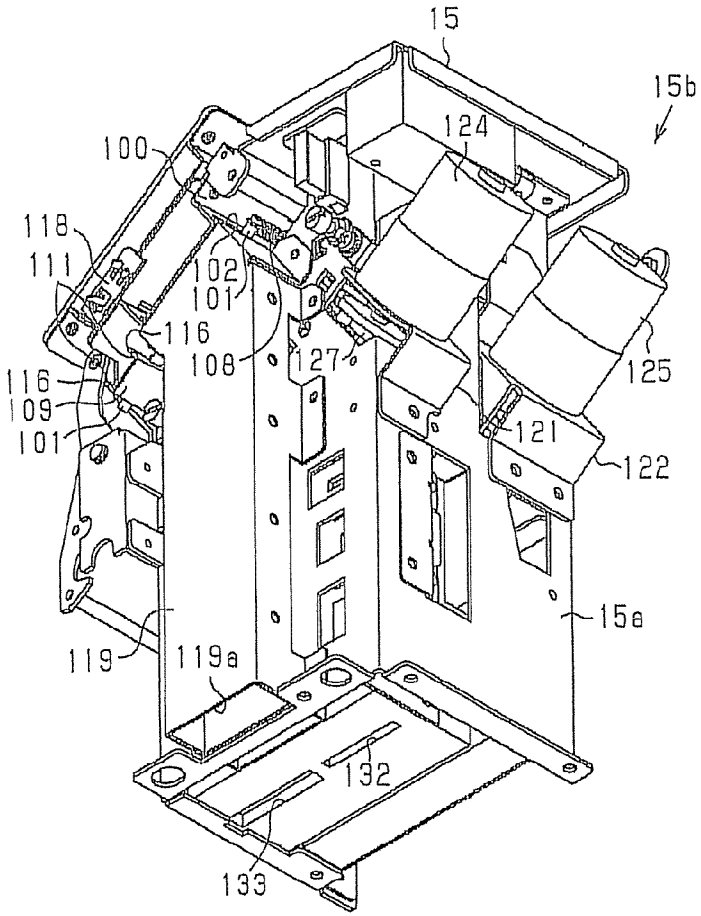
FIG. 24 is a perspective view of the coin validating module viewed from the back.

As shown in FIGS. 21 and 24, a bypass-use coin chute 119 through which coins received from the backup coin entrance 104*b* pass is provided in a side portion of the module body 15*a*. The bypass coin chute 119 comprises a coin bypass passages 120 inside.

<Description of the Coin Validating Module 15>

Figure 25:
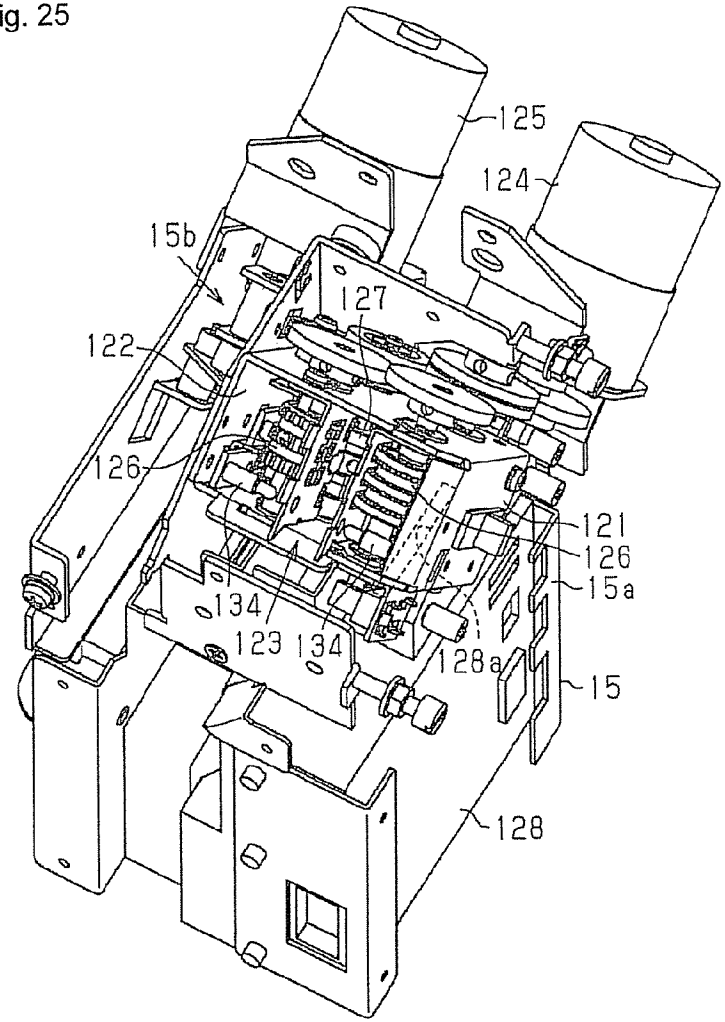
FIG. 25 is a perspective view of the coin validating module in a state where a movable roller is placed at an approach position.
Figure 26:
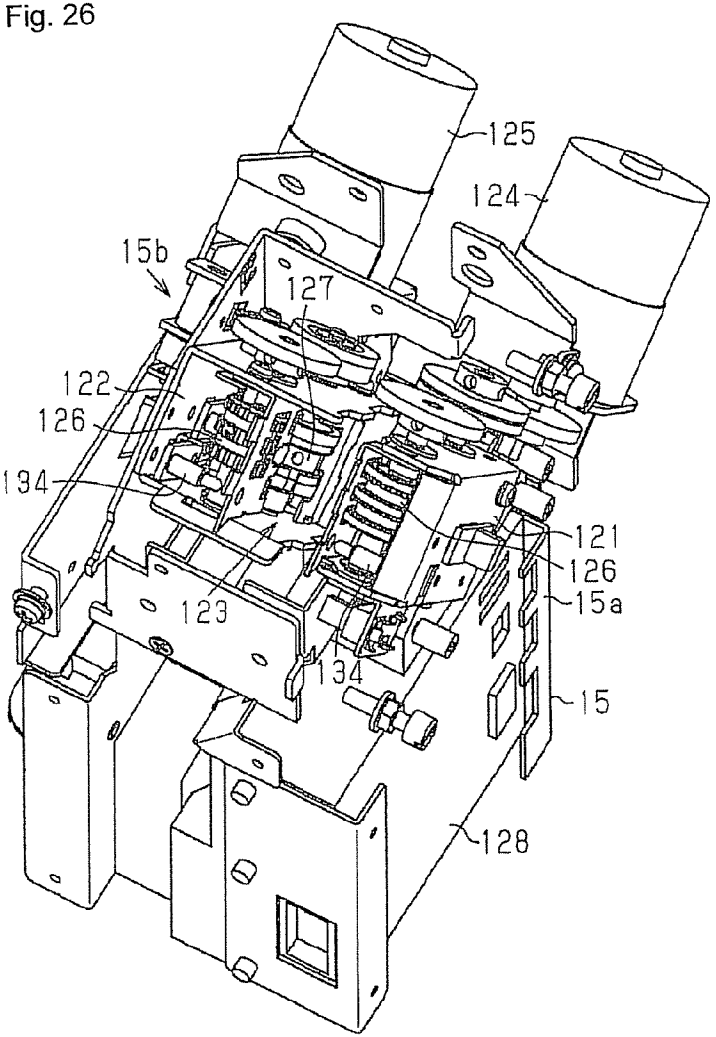
FIG. 26 is a perspective view of the coin validating module in a state where the movable roller is placed at an alienation position.

Next, the configuration of the coin validating module 15 is described. As shown in FIGS. 25 and 26, the module body 15*a* comprises a coin singulator 15*b* to feed coins dropped from the normal coin entrance 104*a* downward, one by one.

The coin singulator 15*b* comprises a pair of rollers 121 and 122 to adjust a flow of coins. The pair of rollers 121 and 122 is composed of a fixed roller 121, the position of which is fixed, and a movable roller 122 capable of making reciprocating movement of moving away from and closer to the fixed roller 121. The rollers 121, 122 constitute a coin normal transportation passage 123 through which coins having entered in from the normal coin entrance 104*a* pass.

A motor 124 to function as a drive source for rotating the rollers 121 and 122, and a motor 125 to function as a drive source for moving the movable roller 122 away from and closer to the roller 121 are attached to the back side of module body 15*a*. The fixed roller 121 comprises: a flow-adjusting roller 126 which rotates in such a direction as to return coins that have dropped from the normal coin entrance 104*a* upward; and a feed roller 127 which feeds coins one by one that have passed over the flow-adjusting roller 126. The movable roller 122 also comprises the flow-adjusting roller 126 and the feed roller 127 likewise.

A coin validator 128 to identify coins that have passed through the feed rollers 127, 127 is provided under the feed rollers 127, 127. The coin validator 128 has a coin passing hole 128*a* at the center of the top face thereof, and validates the kinds of coins when coins pass through this coin passing hole 128*a* one by one. The coin validator 128 also validates whether each received coin is a true coin. Although any one of various coin validators can be used as the coin validator 128, Currenza f2 manufactured by a German company called NATIONAL REJECTORS, INC., GmbH is used in the present embodiment.

Figure 23:
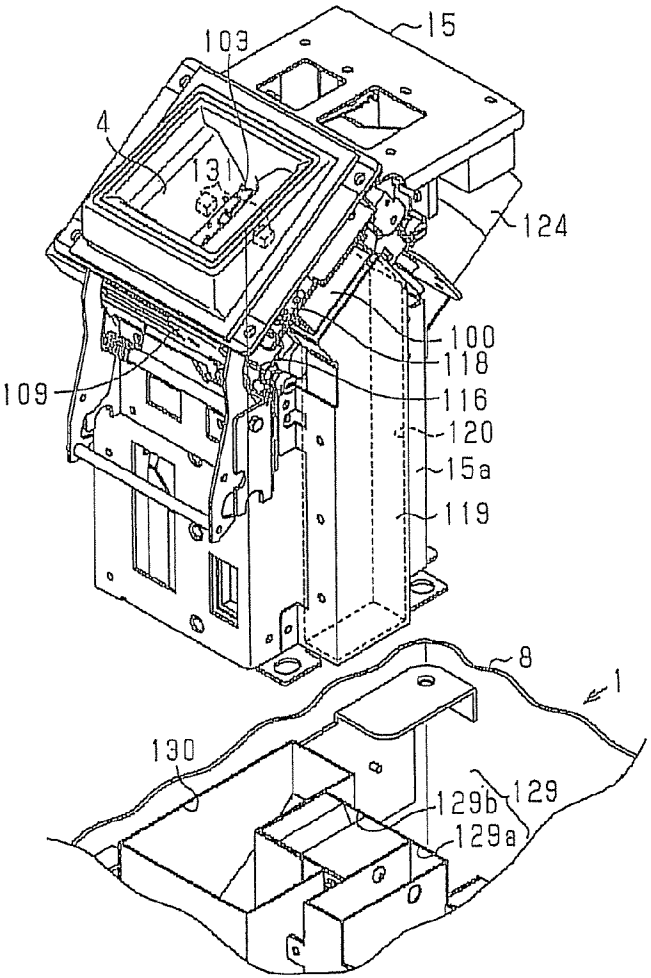
FIG. 23 is a perspective view of a coin validating module viewed from the front.

As shown in FIG. 23, a cashbox side coin chute 129 connecting with the cashbox 20 and a return-opening side coin chute 130 connecting with the coin return opening 9 are provided below the coin validating module 15. Two chutes 129*a* and 129*b* are formed in the cashbox side coin chute 129, the chute 129*a* connecting with an exit 119*a* of the bypass-use coin chute 119, and the chute 129*b* connecting with the coin normal transportation passage 123. Coins that pass through the bypass-use coin chute 119 enter the cashbox 20 by way of the cashbox side coin chute 129*a*.

Additionally, as shown in FIG. 23, the coin acceptor 4 comprises coin-receipt detection sensors 131 to detect whether the coin acceptor 4 has received a coin. Each of the coin-receipt detection sensors 131 is an optical sensor, and the plural coin-receipt detection sensors 131 are provided so that the coin acceptor 4 may be sandwiched therebetween. When the coin-receipt detection sensor 131 detects receipt of a coin, the coin validating module 15 drives the motor 124 to start coin transportation.

At normal times, as shown in FIGS. 23 to 25, the coin validating module 15 takes a positional state in which the movable roller 122 is close to the fixed roller 121, and feeds coins that have come dropping, into the coin validator 128 one by one. The coin validator 128 identifies each received coin. Then, when the coin is a true coin, the coin validator 128 discharges the true coin from a discharge opening 132 in the lower face of the coin validator 128 to the cashbox side coin chute 129*b*. On the other hand, when the coin validator 128 identifies a received coin as a false one, the false coin is discharged to the return-opening side coin chute 130 from a discharge opening 133 in the lower face of the coin validator 128.

Additionally, the coin normal transportation passage 123 of the coin validating module 15 comprises plural coin jamming detection sensors 134 to detect occurrence of jamming of a coin in the coin normal transportation passage 123. Each of the coin jamming detection sensors 134 is an optical sensor, and is attached to the fixed roller 121.

When the coin jamming detection sensors 134 have detected occurrence of jamming of coins between the rollers 121 and 122, the coin validating module 15 drives the motor 125 to move the movable roller 122 away from the fixed roller 121 as shown in FIG. 26. When the movable roller 122 is placed at a position away from the roller 121, a large gap is created between the rollers 121 and 122, whereby the stuck coins drops downward. The coins having dropped as a result of this jamming clearance operation enter the return-opening side coin chute 130, and are discharged to the coin return opening 9.

At the occurrence of jamming of coins in the coin normal transportation passage 123, it is possible to switch coin transportation passages from the coin normal transportation passage 123 to the coin bypass passages 120 by use of the valve member 99 of the coin transportation passage switch mechanism 95. Therefore, it is made possible to continue receiving coins even after the occurrence of jamming of a coin in the coin normal transportation passage 123. Additionally, after the switching of coin transportation passages, the coin acceptor 4 is still used the same as before the switching, whereby, even when a lot of coins are cast into the coin acceptor 4, the coin acceptor 4 sequentially receives the coins without causing jamming and therefore can deal with the switching.

In this embodiment, the structure of the coin transportation passage switch mechanism 95 can be simplified because the coin transportation passage switch mechanism 95 is manually operated.

After the coin bypass passage 120 is put into operation with the valve member 99 moved to the bypass position by the coin transportation passage switch mechanism 95, the valve member 99 is maintained at the bypass position by the locking mechanism 117, whereby it is impossible to return the valve member 99 to the normal position only by operating the coin transportation passage switch lever 96. This makes it possible to reduce a risk of having a coin inserted in the coin normal transportation passage 123 at the occurrence of jamming of coins therein.

The locking mechanism 117 of the coin transportation passage switch mechanism 95 is arranged inside the top lid 10. Therefore, the valve member 99 located at the bypass position cannot be returned to the normal position unless the top lid 10 is opened by unlocking the cylinder lock 12 of the top lid 10. This prevents unauthorized unlocking of the locking mechanism 117.

The coin transportation passage switch mechanism 95 comprises the linkage mechanism 62 arranged along the inner face of the sidewall 10*a* of the top lid 10. This makes it possible to use an unused space inside the top lid 10 effectively for arranging members constituting the bill receiving opening switch mechanism 56.

Thus, passengers are allowed to smoothly pay the fares not only because bills can be received by the bill bypass passage 84 even at the occurrence of jamming of a bill, but also because coins can be received by the coin bypass passages 120 even at the occurrence of jamming of coins.

<Description of Downstream Passages for Money and the Surroundings Thereof>

Figure 27:
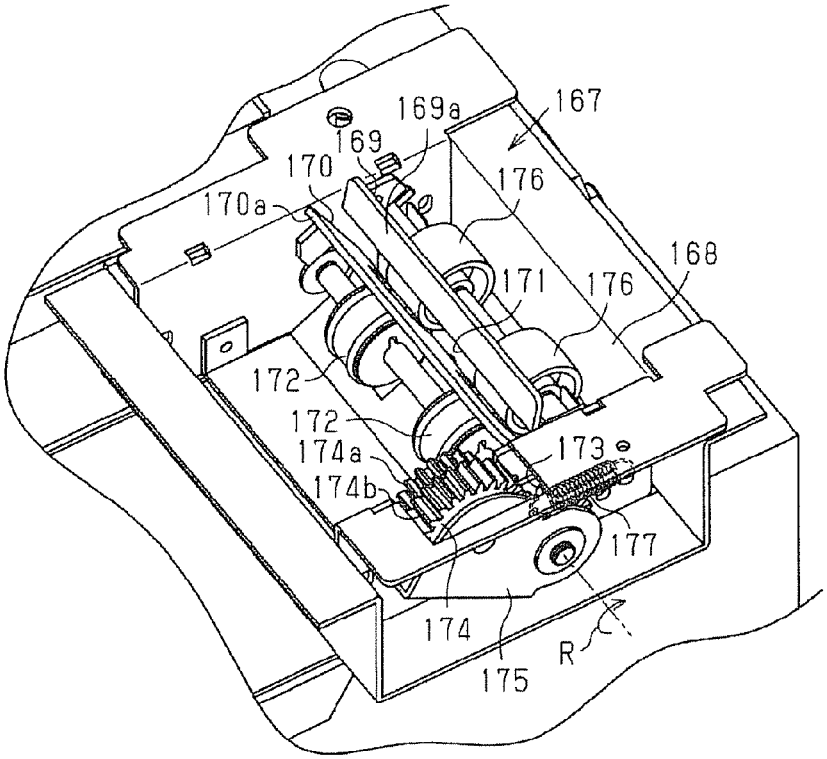
FIG. 27 is a perspective view showing the outer appearance of a bill feeding lower passage mechanism.
Figure 28:
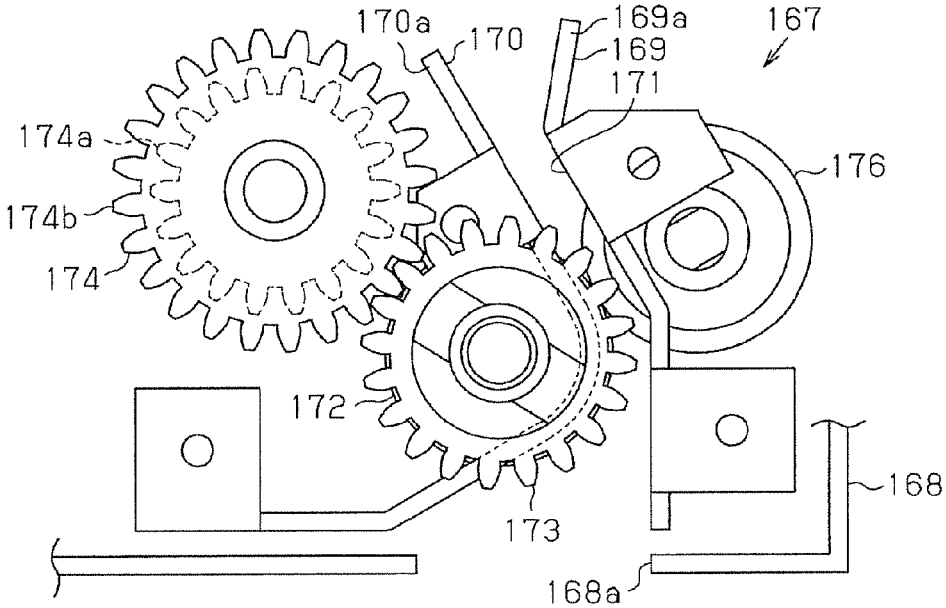
FIG. 28 is a side view showing the configuration of the bill feeding lower pas sage mechanism.

As shown in FIGS. 27 and 28, a bill feeding lower passage mechanism 167 to feed bills discharged from the bill validating module 14 into the cashbox 20 is provided under the bill validating module 14 in the main body 8. The bill feeding lower passage mechanism 167 comprises a frame wall 168 formed in a frame-like shape. The top face of the frame wall 168 is open, and a bill passage hole 168*a* (illustrated in FIG. 28) is opened through the bottom wall of the frame wall 168. The frame wall 168 is formed by joining plural metal plates together.

Inside the frame wall 168, two boards 169 and 170 arranged facing each other constitute the bill feeding lower passage 171, which is a bill passage under the bill validating module 14. Guide sections 169*a* and 170*a* for bills are formed in the upper ends of the two boards 169 and 170 by being bent in such directions as to further separate from each other. Additionally, the two boards 169 and 170 are arranged tilting by predetermined angles to the vertical direction of the main body 8. The bill feeding lower passage 171 thereby assumes a bent shape, and a bill passage from the bill validating module 14 to the cashbox 20 appears substantially U-shaped in a cross-sectional view. Therefore, when the bill feeding lower passage 171 is viewed from above, it is impossible for the line of sight to linearly reach an exit thereof, and the inside of cashbox 20 is less likely to be viewed.

A pair of bill transportation rollers 172, 172 to transport a bill downward in the bill feeding lower passage 171 is provided to the bill feeding lower passage mechanism 167 so as to be rotatable. At positions facing the bill transportation rollers 172, 172, a pair of driven rollers 176, 176 to catch a bill in cooperation with the bill transportation rollers 172, 172 in the interstice therebetween and to guide fed bills are provided so as to be rotatable.

A roller gear 173 to integrally rotate with the bill transportation rollers 172, 172 is attached to an axial end of these rollers. A coupling gear 174 to transmit rotation of the driven gear 166 (refer to FIG. 18) of the bill validating module 14 to the roller gear 173 and rotate the bill transportation rollers 172 meshes with the roller gear 173. The coupling gear 174 has a small-diameter gear 174*a* and a large-diameter gear 174*b*. The small-diameter gear 174*a* can mesh with the driven gear 166, whereas a large-diameter gear 174*b* can mesh with the roller gear 173. The coupling gear 174 is pivotally supported and provided to a coupling 175 so as to be rotatable.

The coupling 175 is made of a plate and supported by an end of the bill transportation rollers 172, and is rotatable about the shaft of the bill transportation roller 172. A biasing member 177 to constantly bias the coupling 175 upward (a direction indicated by the arrow R in FIG. 27) is attached between the coupling 175 and the frame wall 168.

When the bill validating module 14 is set in the electrical component storage 13, the driven gear 166 of the bill validating module 14 is pushed from above against the small-diameter gear 174*a* of the coupling gear 174, so that the coupling gear 174 meshes with the driven gear 166. Therefore, when the driven gear 166 rotates along with rotation of the motor 92 of the bill validating module 14, the coupling gear 174 is driven to rotate. Thus, the roller gear 173 meshing with the coupling gear 174 rotates, and the bill transportation rollers 172, 172 rotate to transport a bill downward.

Figure 29:
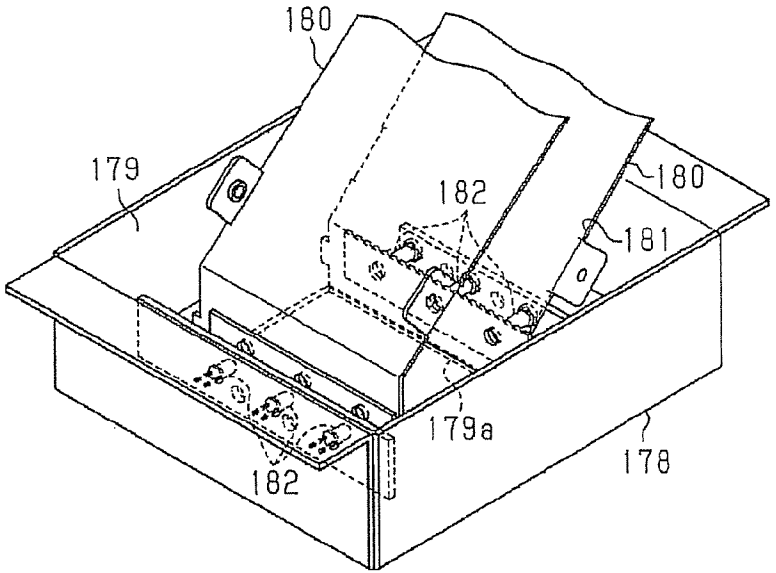
FIG. 29 is a perspective view showing the outer appearance of a coin feeding lower passage.

As shown in FIG. 29, a coin feeding lower passage 178 to feed coins discharged from the coin validating module 15 into the cashbox 20 is provided under the coin validating module 15 in the main body 8. The coin feeding lower passage 178 comprises a frame wall 179 in a frame-like shape. The top face of the frame wall 179 is open, and a coin passage hole 179*a* is opened through the bottom wall of the frame wall 179. The coin feeding lower passage 178 is provided with a pair of boards 180, and a coin feeding lower passage 181 is formed by a space between the boards 180, 180 and the coin passage hole 179*a*. The passages of the cashbox side coin chutes 129*a* and 129*b* join each other in the coin feeding lower passage 181.

The coin feeding lower passage 178 is provided with plural coin jamming detection sensors 182 to detect an abnormal accumulation of coins has occurred in the coin feeding lower passage 181. For each of the coin jamming detection sensors 182, a photo-coupler is used, for example. The coin jamming detection sensors 182 are arranged in parallel lines. When coins have accumulated in the coin feeding lower passage 181, the detection sensors 182 detect the presence of coins, and notify the controller 135 of the occurrence of an unusual event. If the cashbox 20 is set in the main body 8 with an entrance of the coin compartment 35 being blocked up by a plate or the like, coins would be dammed up and pile up outside the entrance of the coin compartment 35. Then, there would be a risk that these coins thus dammed up and being outside the cashbox 20 might be stolen when the cashbox 20 is detached from the fare box 1. The coin jamming detection sensors 182 of this embodiment detect whether coins have accumulated in the coin feeding lower passage 181, and notify the controller 135 thereof, thereby making it possible to discover such an illicit act as blocking up the entrance of the cashbox 20.

Figure 30:
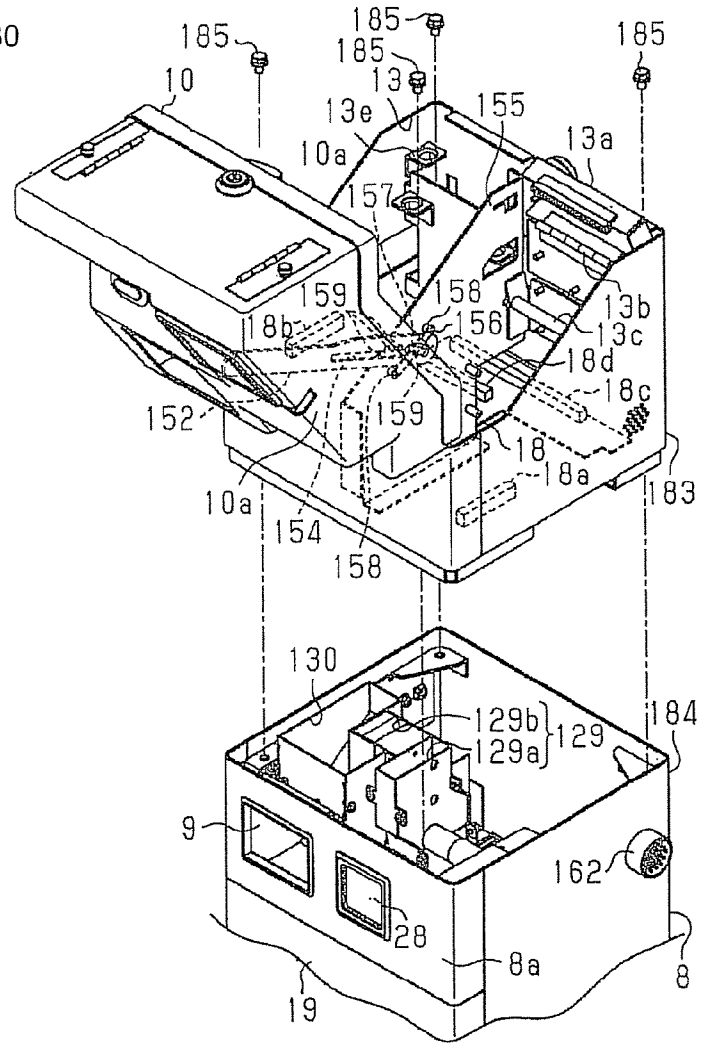
FIG. 30 is a perspective view showing a state where the main body is separated into the upper part and the lower part.

As shown in FIG. 30, the fare box 1 is separable into a box upper part 183 and a box lower part 184. The box lower part 184 is provided with components such as the above described cashbox door 19, the cashbox 20, the cashbox door locking mechanism 23, the bill feeding lower passage mechanism 167, the coin feeding lower passage 178.

The reason for making the box upper part 183 and the box lower part 184 separable is to enable maintenance on the cashbox door locking mechanism 23 in the box lower part 184 by making the box upper part 183 removable from the box lower part 184. It is possible to integrally assemble the box upper part 183 and the box lower part 184 by means of fasteners 185 attached to the four corners inside the main body 8. As each of the fasteners 185, a screw is used for example.

<Description of the Electrical Configuration of the Fare Box 1>

Figure 31:
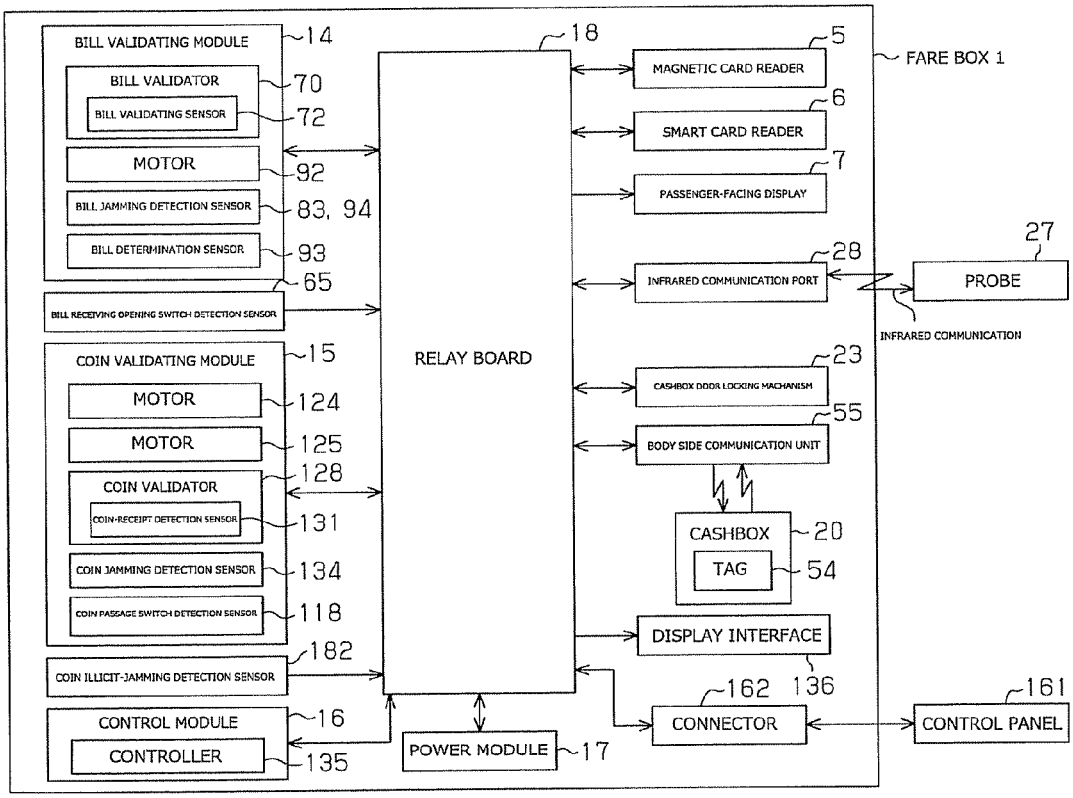
FIG. 31 is a block diagram showing the electric configuration of the fare box.

Next, the electrical configuration of the fare box 1 is described. As shown in FIG. 31, the control module 16 is provided with the controller 135 which performs integrated control over operation of the fare box 1. The bill validating module 14, the coin validating module 15, the magnetic card reader 5, the smart card reader 6, the passenger-facing display 7, the power module 17, the infrared communication port 28 and the body side communicator 55 is connected to the control module 16 via the relay board 18. The controller 135 is a control board comprising electronic components (illustration is omitted) such as a CPU, a ROM and a RAM. Additionally, a display interface 136 to inform operating conditions of fare box 1 is connected to the control module 16. The display interface 136 is a liquid crystal display of a control console (illustration is omitted) provided to the driver's seat. The bill validating module 14 and the coin validating module 15 are controlled by the control module 16, and power is supplied thereto from the power module 17.

When jamming of a bill has been detected by the bill jamming detection sensors 83 and 94, the controller 135 notifies a driver (an operator) of the jamming of a bill through indication of the display interface 136. Additionally, when jamming of a coin has been detected by the coin jamming detection sensor 134, the controller 135 notifies the driver of jamming of a coin through indication of the display interface 136 when it is impossible to clear the jamming of a coin even by operating the movable rollers 122.

The bill receiving opening switch detection sensor 65 and the coin passage switch detection sensor 118 are also connected to the control module 16. When an ON signal is input to the controller 135 from the bill receiving opening switch detection sensor 65, the controller 135 executes, via the display interface 136, notification indicating that the shutter 57 has been shifted to the bypass position from the normal position.

Further, when an ON signal is input to the controller 135 from the coin passage switch detection sensor 118, the controller 135 executes, via the display interface 136, notification indicating that the valve member 99 has been shifted to the bypass position from the normal position.

<Description of the Operation of the Fare Box 1>

Next, behavior of this fare box 1 in question is described using FIGS. 14, 15, 21, 22, 32 and 33.

Figure 32:
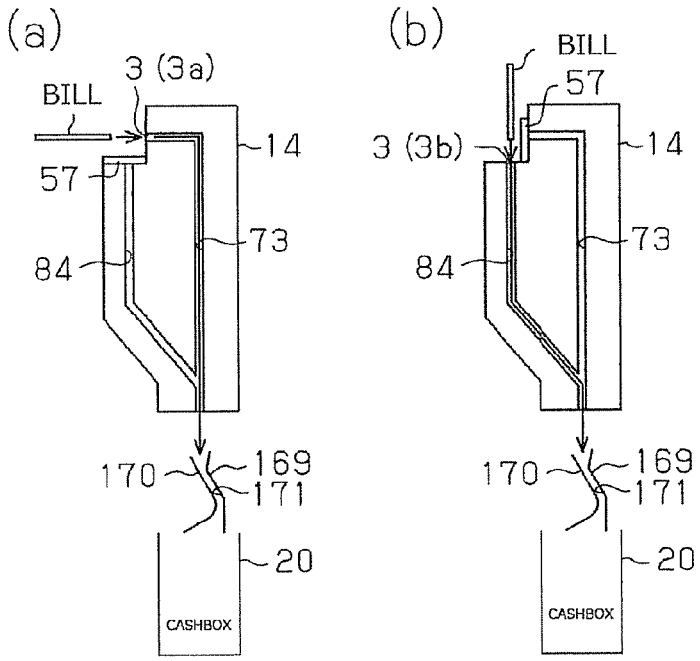
Figure 33:
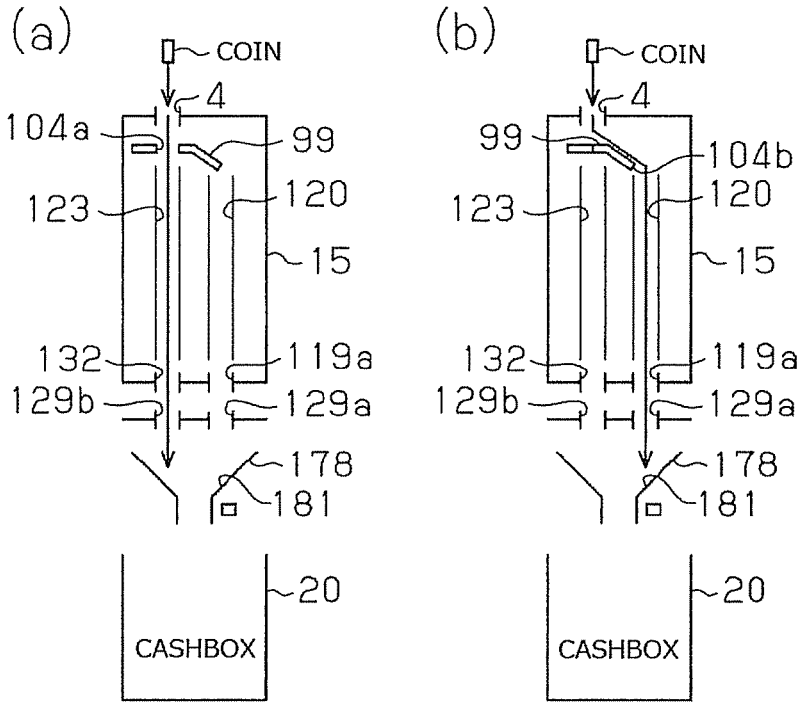

First, a case where the fare is paid in bill is described. At normal times, the bill receiving opening switch lever 59 is raised, and the shutter 57 is placed at the normal position, as shown in FIG. 14. Therefore, as shown in FIG. 32(*a*), the bill backup receiving opening 3*b* is closed by the shutter 57, and the bill normal receiving opening 3*a* is opened. Therefore, when paying fares, passengers are allowed to insert bills into the bill normal receiving opening 3*a* without using a wrong bill receiving opening.

Bills inserted into the bill normal receiving opening 3*a* are transported to the cashbox 20 through the bill normal transportation passage 73 after the kinds thereof are identified by the bill validator 70.

A case where the bill normal transportation passage 73 is jammed with a bill is described. When the bill jamming detection sensor 83 has detected jamming of a bill, the controller 135 notifies the driver thereof by indicating on the display interface 136 that jamming of a bill has occurred. The driver thereby recognizes that jamming of a bill has occurred in the bill normal transportation passage 73.

Upon recognizing that jamming of a bill has occurred, the driver operates the bill receiving opening switch lever 59 by flipping the lever downward as shown in FIG. 15.

The shutter 57 connecting with the bill receiving opening switch lever 59 through the linkage mechanism 62 rotates about the shaft 58, thereby being shifted to the bypass position from the normal position. Therefore, as shown in FIG. 32(*b*), the bill normal receiving opening 3*a* is closed by the shutter 57, and the bill backup receiving opening 3*b* is opened. Therefore, passengers are allowed to insert bills into the fare box 1 by using the bill backup receiving opening 3*b* despite the occurrence of jamming of a bill in the bill normal transportation passage 73. A bill received from the bill backup receiving opening 3*b* is transported to the cashbox 20 through the bill bypass passages 84 without validation by the bill validator 70.

Next, a case where the fare is paid in coin is described. As shown in FIG. 21(*a*), at normal times, the valve member 99 is moved to the side opposite to the coin guiding part 103 against the biasing forces of the biasing members 108, whereby the support shaft 101 is engaged with the engagement recesses 116 of the lever 109. Therefore, as shown in FIG. 32(*a*), the valve member 99 is placed at the normal position, and the normal coin entrance 104*a* is opened. Therefore, a coin received by the coin acceptor 4 enters the normal coin entrance 104*a*, and is transported to the cashbox 20 through the coin normal transportation passage 123.

Here, a case where the coin normal transportation passage 123 is jammed with a coin is described. On the basis of detection of the jamming from the coin jamming detection sensors 134, the controller 135 moves the movable roller 122 away from the fixed roller 121. The coin normal transportation passage 123 is enlarged in width, and the stuck coin drops, whereby the jamming is cleared. However, there may be a case where jamming of a coin cannot be cleared even when the movable roller 122 is moved away from the fixed roller 121. At this time, the controller 135 notifies a driver of the jamming of a coin via a display interface 136 on the basis of detection from the coin jamming detection sensor 134. The driver thereby recognizes the jamming of a coin in the coin normal transportation passage 123.

Upon recognizing that jamming of a coin has occurred, the driver knocks the coin transportation passage switch lever 96 downward as shown in FIG. 22. At this time, the lever pushing-up piece 113 connecting with the coin transportation passage switch lever 96 via the linkage mechanism 112 moves upward, and lifts up the bottom end of the lever 109 from below. The lever 109 rotates about the fixed shaft 106 in the clockwise direction of FIG. 22. Then, the support shaft 101 having been engaged with the engagement recesses 116 of the lever 109 comes off from the engagement recesses 116, and is released from the engagement. Therefore, as shown in FIG. 21(*b*), the valve member 99 slides towards the coin guiding part 103 due to the biasing forces of the biasing members 108.

As a result, as shown in FIG. 32(*b*), the valve member 99 is placed at the bypass position, the normal coin entrance 104*a* is closed, and the backup coin entrance 104*b* is opened. A coin received by the coin acceptor 4 enters the backup coin entrance 104*b*, and is transported to the cashbox 20 through the coin bypass passages 120 without having a kind thereof determined by the coin validator 128.

In this embodiment, as described above, the fare box 1 is provided with two entrances for bills, which are the bill normal receiving opening 3*a* and the bill backup receiving opening 3*b*, and either of the bill normal receiving opening 3*a* and the bill backup receiving opening 3*b* can be selectively opened by the shutter 57. Therefore, at normal times, the shutter 57 is placed at the normal position, and the bill normal receiving opening 3*a* is put into operation. At the occurrence of jamming of a bill in the bill normal transportation passage 73, the shutter 57 is rotated to the bypass position by operating the bill receiving opening switch lever 59, whereby the bill backup receiving opening 3*b* is opened in place of the bill normal receiving opening 3*a*.

After the occurrence of jamming of a bill in the bill normal transportation passage 73, it is possible to store bills in the cashbox 20 through the bill bypass passages 84. Therefore, it is possible to continue receiving bills despite the occurrence of jamming of a bill in the bill normal transportation passage 73. Further, when the bill backup receiving opening 3*b* is put into operation, the bill normal receiving opening 3*a* is closed by the shutter 57, passengers immediately recognize that the bill backup receiving opening 3*b* should be used. Therefore, when the bill normal transportation passage 73 has become unusable at the occurrence of jamming of a bill in the bill normal transportation passage 73 or at the occurrence of a failure in the bill validator 70, it is possible to smoothly continue receiving bills.

Additionally, the coin acceptor 4 is provided with the valve member 99, and either of the normal coin entrance 104*a* and the backup coin entrance 104*b* is selectively put into operation by the valve member 99. Therefore, despite the occurrence of jamming of a coin in the coin normal transportation passage 123, the use of the backup coin entrance 104*b* makes it possible to continue receiving coins. Further, the same coin acceptor 4 is shared by both of the normal coin entrance 104*a* and the backup coin entrance 104*b*, which eliminates the need of providing plural acceptors.

Other Examples

Figure 34:
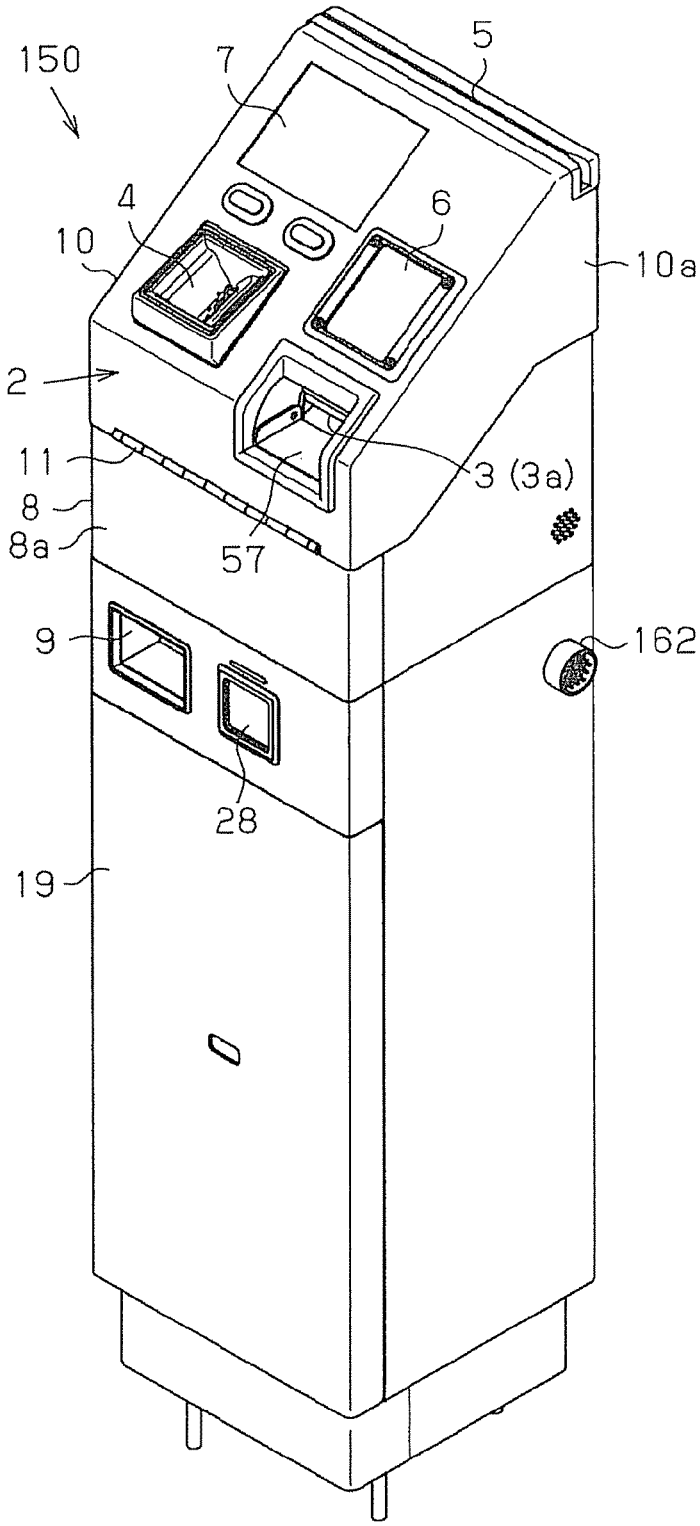
FIG. 34 is a perspective view of a fare box according to an embodiment given as another example.
Figure 35:
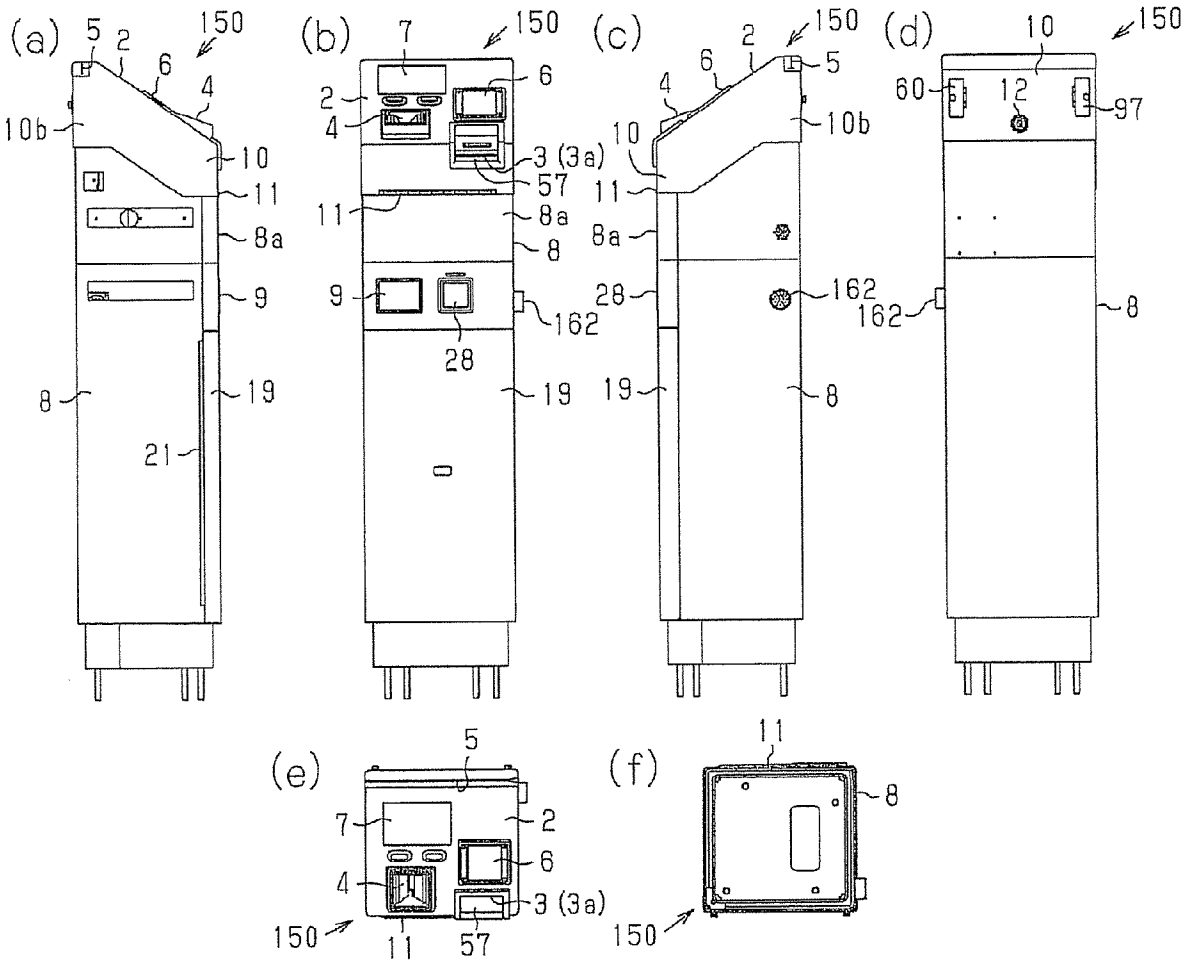

Next, a fare box 150 according to another embodiment of the present invention is described in accordance with FIGS. 34 and 35. Note that elements of the fare box 150 that are also used in the fare box 1 are denoted by the same reference signs.

FIG. 34 is a perspective view showing the top face, the front face and the right side face of the fare box 150. The bill acceptor 3, the coin acceptor 4, the magnetic card reader 5, the smart card reader 6 and the operation panel 2 having a passenger-facing display 7 are provided in a front upper portion of the fare box 150. The coin return opening 9 and the infrared communication port 28 are provided in the front wall 8*a* of the fare box 150. FIG. 35 is a combination of the views showing the fare box 1, wherein: FIG. 35(*a*) is a left side view; FIG. 35(*b*), a front view; FIG. 35(*c*), a right side view; FIG. 35(*d*), a back view; FIG. 35(*e*), a top view; and FIG. 35(*f*), a bottom view.

In the fare box 150, the top face of the top lid 10 is entirely formed of a smooth sloping surface, and has a simple structure. The bill acceptor 3 has a recess corresponding to the widths of bills, and the shutter 57 is thereby less conspicuous, whereby a bill receiving opening usable by passengers can be easily recognized regardless of which of the bill normal receiving opening 3*a* and the bill backup receiving opening 3*b* is used.

The present invention is not limited to the configurations of the above embodiments, and various changes or improvements can be made thereto without departing from the spirit and the scope of the present invention. For example, the above embodiments may be changed in the following manners.

Figure 36:
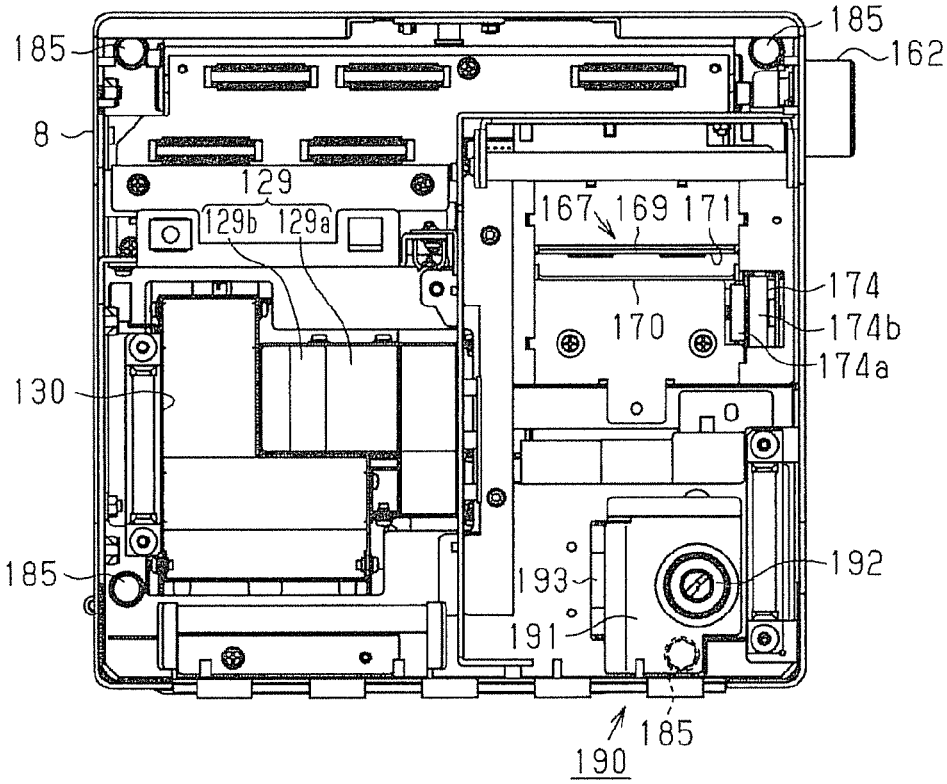
FIG. 36 is a plan view showing the inside of the main body according to still another example.
Figure 37:
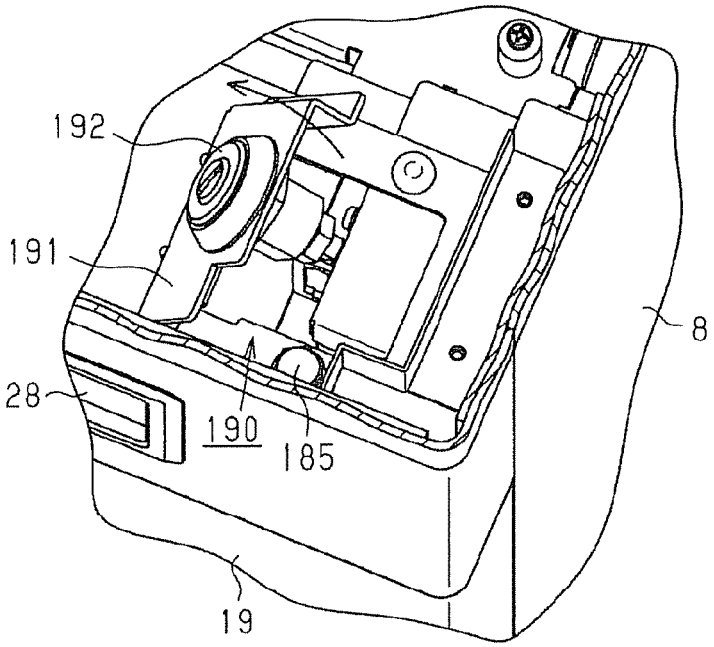
FIG. 37 is a perspective view showing a state where an opening operation is performed on a locking mechanism.

As shown in FIGS. 36 and 37, in place of the locking portion 13*a* to regulate detachment of the bill validating module 14, a lock 190 to regulate detachment of one of fasteners 185 located at four corners inside the main body 8 may be provided. The lock 190 is provided with: a covering lid 191 covering the fastener 185 from above; and a cylinder lock 192 to lock this covering lid 191 in a closed state. The covering lid 191 is attached to a box upper portion 183 so as to be laterally openable by means of a hinge mechanism 193. This covering lid 191 covers the above described cashbox door locking mechanism 23 as well as the fastener 185 from above. Therefore, a person other than one having the authority to manage the key of this cylinder lock 192 is not allowed to open the covering lid 191 as shown in FIG. 37, which prevents unauthorized detachment of the fastener 185 and unauthorized operation of the cashbox door locking mechanism 23.

The shutter 57 is not limited to one functioning by rotating about a shaft, and may be one functioning to selectively open any one of plural bill receiving openings by sliding to change the position thereof.

The fare box 1 may further comprise: an input device through which an operator such as a driver inputs the amount of money received by the cashbox 20 through bypass passages (the bill bypass passages 84 and the coin bypass passages 120); and a memory device to store the amount of money input through the input device. In this case, the monetary data received while each of the bypass passages is used can be stored in the fare box 1.

The valve member 99 is not limited to one hidden inside the top lid 10 and may be exposed outside the top lid 10.

The bill receiving opening switch mechanism 56 and the coin transportation passage switch mechanism 95 are not limited to those in the above embodiments, and may be changed as appropriate. The bill validating module 14 and the coin validating module 15 also may be changed.

The bill receiving opening switch mechanism 56 and the coin transportation passage switch mechanism 95 are not limited to those to be manually operated, and may be those to be operated electrically or by a mechanical force.

The shutter 57 is not limited to one hidden inside the top lid 10 and may be exposed outside the top lid 10.

The shutter may be detected at the two positions not only by using the bill receiving opening switch detection sensor 65 to detect when the shutter 57 is located at the bypass position, but also by having sensors to detect when the shutter 57 is located at the normal position.

The locking mechanisms 67 and 117 may include release mechanisms thereof outside the main body 8, and unlocking thereof without opening the top lid 10 may be allowed.

The structure for storing electrical components such as the bill validating module 14, the coin validating module 15, the control module 16, and the power module 17 may be changed as appropriate. For example, partition plates may be provided in the electrical component storage 13, and each module may be positioned thereby being stored. Additionally, instead of a lid that opens upward, the electrical component storage 13 may be openable and closable by a door provided on the front side or a lateral side of the main body 8, and the electrical components may be put in and out sideways.

A method for the authentication for unlocking the cashbox door locking mechanism 23 is not limited to the infrared communication system employing the probe 27, and may be a system with a keyboard for manually inputting a secret code. Alternatively, a wireless communication with an IC tag or an authentication with a magnetic card may be used, or plural ones of these methods may be used in combination.

A method for the authentication of the cashbox 20 is not limited to an authentication method using short range wireless communication, and other methods may be adopted. Another wireless communication means such as infrared communication may be used, or communication may be established by connecting the cashbox and the fare box to each other via electrical contacts.

The sensors and actuators mounted on the fare box 1 are not limited to those described in the embodiments, and may be changed as appropriate.

The top lid 10 is not limited to one having the hinge 11 on the front side and having the cylinder lock 12 on the back side, and may have the hinge in the back side or either one of the lateral sides and have the cylinder lock 12 in the front side or the other lateral side. In a case where the hinge is provided in the back side or a lateral side, maintenance from the front side is facilitated.

In the following section, the technical ideas observed in the embodiments are described.

(A) In one aspect, the present invention provides a fare box comprising a main body, a bill normal receiving opening, a bill normal transportation passage, a bill backup receiving opening, a bill bypass passage, a shutter, and a bill receiving opening switch mechanism. The cashbox is retained in the main body and storing money. The bill normal receiving opening is provided on an outer face of the main body and accepting a bill. The bill normal transportation passage transports the bill accepted at the bill normal receiving opening to the cashbox. The bill backup receiving opening is on an outer face of the main body for accepting a bill. The bill bypass passage that transports the bill accepted at the bill backup receiving opening to the cashbox. The shutter that takes either of two positions selectively, the two positions being a normal position at which the shutter opens the bill normal receiving opening and a bypass position at which the shutter opens the bill backup receiving opening. The bill receiving opening switch mechanism that shifts the position of the shutter to open one of the bill receiving openings.

According to this configuration, not only the bill normal receiving opening but also the bill backup receiving opening are provided as bill receiving openings of the fare box, and either one of these bill receiving openings is selectively opened, or closed by the shutter. Therefore, at the occurrence of jamming of a bill in the bill normal transportation passage, the bill normal receiving opening is closed by the shutter, and the bill backup receiving opening is opened, so that the bill backup receiving opening is used to receive bills. Therefore, even when the bill normal transportation passage is unusable because of a problem such as jamming of a bill having occurred in the bill normal transportation passage, passengers are allowed to continue fare payment with bills. Additionally, when the bill normal transportation passage is unusable, the bill backup receiving opening is opened with the bill normal receiving opening being closed, whereby passengers can immediately notice that the bill normal transportation passage is unusable. This makes it possible to smoothly continue receiving fares paid with bills even when the bill normal transportation passage is unusable.

(B) In another aspect, the bill receiving opening switch mechanism further comprises: a switch controller which is provided outside the main body, and by use of which the shutter is manually shifted from the normal position to the bypass position; and a switch transmission mechanism which actuates the shutter in accordance with an operation at the switch controller. According to this configuration, the mechanism for shifting the position of the shutter can be simplified because the position of the shutter is manually shifted.

(C) In still another aspect, the bill receiving opening switch mechanism further comprises a locking mechanism which maintains the shutter at the bypass position by engaging with the shutter when the shutter is positioned at the bypass position at which the shutter opens the bill backup receiving opening. According to this configuration, the shutter is maintained at the bypass position by the locking mechanism when taking the bypass position. Thus, it is impossible to shift the shutter to the normal position after the shutter shifted to the bypass position for putting the bill bypass passages into operation. It is therefore possible to make less likely a situation in which a passenger inserts a bill into the bill normal transportation passage jammed with a bill.

(D) In still another aspect, while the main body comprises a lockable lid, the bill receiving opening switch mechanism further comprising an engagement release mechanism provided inside the main body in such a manner as to be capable of accepting a release operation when the lid is opened, and release the engagement of the locking mechanism when accepting the release operation. According to this configuration, releasing the engagement of the locking mechanism requires that the engagement release mechanism be operated with the lid opened. Therefore, the lid should be unlocked first to manipulate the release mechanism and release the locking mechanism from the engagement when the lid has been locked. This makes it possible to prevent a person, who does not have the authority to unlock the lid, from unlocking the locking mechanism illicitly.

(E) In still another aspect, the switch transmission mechanism is a linkage mechanism, which is arranged along an inner face of a sidewall of the main body and actuates the shutter by transmitting an operating force from the switch controller to the shutter. According to this configuration, this linkage mechanism is provided in the bill receiving opening switch mechanism, and is arranged at a marginal portion of the main body along an inner face of a sidewall of the main body. It is thereby possible to make the switching transmission mechanism less likely to interfere with other mechanisms and devices stored in the main body, and to arrange mechanisms and devices therein more densely, whereby upsizing of the fare box can be prevented.

(F) In another aspect, the fare box further comprises a bill transportation device, an inserted-object detector and a bill determination section. The bill transportation device is provided to the bill bypass passage and capable of transporting an inserted object inserted into the bill backup receiving opening to the cashbox. The inserted-object detector is provided to the bill backup receiving opening, and detects whether the inserted object inserted into the bill backup receiving opening is an alien substance.

The bill determination section determines, on the basis of the detection result of the inserted-object detector, whether the inserted object is a bill, and controls the bill transportation device so as to cause the bill transportation device to transport only the inserted objects that have been determined to be bills to the cashbox. According to this configuration, whether an inserted object put in the bill backup receiving opening is an alien substance is detected, and receiving bills is executed only when the inserted object is determined to be a bill. It thereby reduces the risk that a magnetic card or other tickets, different in size from bills, are mistakenly taken in the main body.

(G) In still another aspect, while the bill bypass passage is vertically arranged on a wall of the main body, the cashbox is arranged under the bill bypass passage. According to this configuration, the bill bypass passage is set along a direction running vertically along the wall of the main body, so that the bill bypass passage is positioned in a marginal portion of the inside of the main body. Therefore, a large storage space inside the main body can be secured. Additionally, the cashbox is placed under the bill bypass passage, whereby, when being transported to the cashbox via the bill bypass passage, bills can be transported to the cashbox through a simple route where bills are transported downward from above. It is thereby possible to makes the bill bypass passage less likely to be jammed with a bill.

(H) In still another aspect, the fare box further comprises a coin acceptor, a coin normal transportation passage, a coin bypass passage and a coin transportation passage switch mechanism. The coin acceptor opens through an outer face of the main body, and receives plural coins. The coin normal transportation passage is provided inside the main body, and transports coins received from the coin acceptor to the cashbox. The coin bypass passage is provided inside the main body, and transports coins received from the coin acceptor to the cashbox. The coin transportation passage switch mechanism comprises a valve member. The valve member is provided in the back side of the coin acceptor so as to be able to slide in a direction intersecting a direction along which coins fall, and selectively opens either of the coin normal transportation passage and the coin bypass passage. The coin transportation passage switch mechanism sets one of the passages to be taken by coins received at the coin acceptor, by the valve member. According to this configuration, it is possible to switch passages for transporting coins from the coin normal transportation passage to the coin bypass passages by use of the coin transportation passage switch mechanism when the coin normal transportation passage has jammed with a coin. Therefore, despite the occurrence of jamming of a coin in the coin normal transportation passage, passengers can continue fare payment with coins. Further, even after passages for transporting coins have been thus switched, the same coin acceptor is used. Therefore, despite that jamming of a coin has occurred and the passage is switched to the coin bypass passage, passengers can pay fares by casting coins into the same coin acceptor as usual.

Incidentally, various techniques devised so far are available for continuous intake of coins by switching passages to the coin bypass passage when the coin normal transportation passage has become jammed with a coin. However, adoption of some structure involves a risk of making a mechanism larger and upsizing a fare box. Examples of such a structure are: one in which switch to the coin bypass passage is implemented by moving the coin acceptor; and one in which switch to the coin bypass passage is implemented by moving devices inside the coin validator. Further, in a case where a coin acceptor has a large opening to receive plural coins, a larger mechanism is also required for adopting a structure where plural coin acceptors are provided and switched by a shutter. In contrast, according to the coin opening switch mechanism of this configuration, internal passages are switched by moving the valve member, and one coin acceptor is shared by the coin normal transportation passage and the coin bypass passages. This makes it possible to prevent upsizing of the fare box.

(I) In still another aspect, the present invention provides a fare box for receiving and storing money paid as fares, which comprises a main body, a coin validating module, a coin normal transportation passage, a bill normal receiving opening, a bill validating module, a bill normal transportation passage, a bill backup receiving opening, a bill bypass passage, a bill receiving opening switch mechanism, a control module, a power module; and electrical component connectors. The main body has an electrical component storage provided inside, and comprises a lockable lid in an upper portion thereof. The electrical component storage opens upward when the lid is opened. The coin validating module comprises a coin validator and a device side connector, and is detachably stored in the electrical component storage. The coin validator determines whether a coin received from the coin acceptor is a true coin, and identifies the denomination thereof. The device side connector is provided in a downward-facing manner. The coin normal transportation passage transports coins determined by the coin validator to be true to a cashbox. The bill normal receiving opening opens on an outer face of the main body, and receives a bill. The bill validating module comprises a bill validator and a device side connector, and is detachably stored in the electrical component storage. The bill validator determines whether a received bill is a true bill, and identifies the denomination thereof. The device side connector is provided in a downward-facing manner. The bill normal transportation passage transports bills determined by the bill validator to be true to the cashbox. The bill backup receiving opening opens on an outer face of the main body, and receives a bill. The bill bypass passage is provided inside the main body, and transports the bill received from the bill backup receiving opening to the cashbox. The bill receiving opening switch mechanism comprises a shutter, a switch controller, a linkage mechanism, a locking mechanism, and an engagement release mechanism. The shutter is capable of selectively opening either of the bill normal receiving opening and the bill backup receiving opening by selectively taking either of two positions. The two positions are a normal position at which the shutter opens the bill normal receiving opening and a bypass position at which the shutter opens the bill backup receiving opening. The switch controller is provided outside the main body and used for manually shifting the shutter from the normal position to the bypass position. The linkage mechanism is arranged along an inner face of a sidewall of the main body and actuates the shutter by transmitting an operating force from the switch controller to the shutter. The locking mechanism maintains the shutter at the bypass position by engaging with the shutter when the shutter is positioned at the bypass position. The engagement release mechanism is provided in the electrical component storage and releases the locking mechanism from the engagement when accepting a release operation. The control module comprises a device side connector provided in a downward-facing manner, is detachably stored in the electrical component storage and processes collection information on received bills and coins on the basis of the validating results of the coin validator and the bill validator. The power module comprises a device side connector provided in a downward-facing manner, is detachably stored in the electrical component storage and supplies power at least to the coin validator, the bill validator and the control module. The electrical component connector comprises main body side connectors provided in an upward facing-manner at positions that allow the respective device side connectors to be connected to the main body side connectors when the coin validator, the bill validator, the control module and the power module are inserted from above and stored in predetermined positions. According to this configuration, the bill bypass passage and the linkage mechanism for switching the bill passages are arranged in a marginal portion of the inside of the main body. In addition, electrical components stored in the electrical component storage, which are the coin validating module, the bill validating module, the control module and the power module, are vertically attachable and detachable. It makes the electrical components less likely to interfere with the bill bypass passage and the bill receiving opening switch mechanism. Additionally, this configuration enables effective utilization of the limited space and prevents upsizing of the fare box. Further, when the electrical components such as the coin validator are stored in the electrical component storage of the fare box, each of the device side connectors and the main body side connector are connected with each other by being positioned by positioning members. This enables to omit harness connection between the corresponding connectors, and simplifies connecting the connectors together when the electrical components are attached.

(J) In still another aspect, while the cashbox is attachable to and detachable from the main body, the fare box further comprises a cashbox side communicator, a body side communicator, and a cashbox authentication processor. Being provided to the cashbox, the cashbox side communicator receives a radio wave, operates by using the electric power of the radio wave as a power supply, and transmits an ID code unique to the cashbox. Being provided to the main body, the body side communicator transmits the radio wave and receives the ID code. The cashbox authentication processor authenticates the cashbox on the basis of the received ID code. According to this con-figuration, the cashbox is authenticated by the processor when the cashbox is mounted on the fare box. This enables confirmation as to whether a proper cashbox has been mounted on the fare box. Additionally, a cashbox attached to the fare box is identified with an ID code. This makes it possible to manage cashboxes in such a manner that, when money in the inside of a cashbox is counted after the cashbox is detached from a fare box, the fare box on which the cashbox has been mounted and the contents of the cashbox are associated with each other.

(K) The shutter has a rotating shaft and a shutter mounted on the rotating shaft and rotatable about the rotating shaft. The bill normal receiving opening is positioned in one side in the direction along which the shutter rotates, whereas the bill backup receiving opening is positioned in the other side thereof across the rotating shaft of the shutter. Either of the bill normal receiving opening and the bill backup receiving opening is selectively opened by having the position of the shutter shifted by the rotation of the shutter. According to this configuration, a fare box can be downsized because a space necessary for shifting the position of the shutter is small. It is thereby possible to reduce a risk that, in a case where the bill bypass passage is provided, the fare box is upsized due to members constituting the bill bypass passage.

(L) In still another aspect, inserted-object detector to detect whether any inserted object, such as a bill, has been inserted into the bill normal receiving opening is provided to the bill normal receiving opening. When the inserted-object detector detects the inserted-object, a bill validating module is driven on the basis of control from a controller. According to this configuration, the bill validating module is stopped when not in use, whereby power can be saved. This prevent a risk of wasting electric power by having the bill validating module driven even in a situation not requiring the bill validating module to be in use, such as when the bill bypass passage is in use.

(M) In still another aspect, the bill validating module to identify the denomination of received bills and transport the bills, the coin validating module to identify the denomination of received coins and transport the coins, the control module to control behavior of the fare box, and the power module to control a power supply of the fare box are arranged so as to line up in a direction along a horizontal plane in the main body. According to this configuration, electrical components do not vertically overlap each other. This makes it possible to independently and individually put each of the electrical components into and out from the electrical component storage, whereby provides excellent workability in performing maintenance on the electrical components. Because the interference between the electrical components is negligible according to this configuration, it eliminates the need of taking out electrical components not needed to be repaired or cleaned in performing maintenance on the fare box, and the need of paying attention to the sequence of the electrical components in storing the electrical components in the main body.

(N) In still another aspect, the fare box further comprises a bill receiving opening switch detection sensor and a display unit. The bill receiving opening switch detection sensor detects which position the shutter is placed at, the normal position or the bypass position. When the detection result of the bill receiving opening switch detection sensor indicates that the shutter is positioned at the bypass position, the display unit indicates to passengers that the bill bypass passage is in use. According to this configuration, not only the open state of the bill backup receiving opening with the shutter positioned at the bypass position, but also the indication of the display unit, can prompt passengers to insert bills into the bill backup receiving opening. This reduces the risk that the use of the bill bypass passage brings discomfort to passengers because the fare box behaves differently from usual.

(O) In still another aspect, the valve member comprises a coin passage switch controller provided outside the main body and used for manually shifting the valve member from the normal position to the bypass position, and the valve member takes either of two positions, which are a normal position at which the valve member opens the normal transportation passage, and a bypass position at which the valve member opens the bypass passage. According to this configuration, a structure for shifting the position of the valve member can be simplified because the position of the valve member is manually shifted.

(P) In still another aspect, the fare box comprises a valve member locking mechanism to maintain the valve member at the bypass position by engaging therewith when the valve member takes the bypass position at which the valve member opens the bypass passage. According to this configuration, it is impossible to return the valve member to the normal position after the coin bypass passage is put into operation with the valve member positioned at the bypass position. Therefore, it makes less likely that a passenger puts a coin into the coin normal transportation passage already jammed with a coin.

(Q) In still another aspect, the valve member locking mechanism comprises a release mechanism provided inside the main body and releases the locking mechanism from the engagement when accepting a release operation with the lid opened. According to this configuration, people other than a person in charge, who has the authority to unlock the lid and handle the devices inside, are not permitted to release the valve member locking mechanism from the engagement. This makes it possible to prevent unauthorized release of the valve member locking mechanism. This prevents the return of the valve member to the normal position even though jamming of a coin has not been cleared due to the arbitrary release of the valve member locking mechanism by a passenger or a driver.

(R) In still another aspect, the fare box comprises a coin transportation passage switch linkage mechanism to transmit an operating force from the coin passage switch controller to the valve member and thereby actuate the valve member, and this linkage mechanism is arranged along an inner face of a sidewall of the main body. According to this configuration, it is possible to utilize an otherwise vacant space in the main body effectively in arranging members constituting the coin transportation passage switch mechanism in. This prevents a problem that such inclusion of plural coin passages requires a larger space in the main body than inclusion of only one coin passage and, without upsizing the main body, brings difficulty in arranging internal members.

(S) In still another aspect, the coin validating module, the bill validating module, the control module and the power module, which are electrical components stored in the electrical component storage, are provided with fasteners used for detachably fixing the respective electrical components to the main body. Specific examples of the fastener include a quick release fastener and a ball lock pin. For example, a quick release fastener can be cited as one of these fasteners that can be fastened to electrical components in such a manner as to prevent the fasteners from falling off. While including a tubular support which supports a pin so that the pin can slide in the axial direction thereof (in a direction along which the pin is taken out and inserted), a quick release fastener has a structure for keeping the pin engaged with the support without falling off the support. Once the support is attached to an electrical component, the quick release fastener does not fall off the electrical component. At the same time, since the pin can slide axially, the electrical component can be fixed to the main body.

This makes it possible to prevent the fastener from falling off the electrical component. Particularly, in a case where the electrical components are vertically attached to and detached from the main body in the case of the above fare box 1, a fastener may drop on a relay board or enter the cashbox when the fastener falls off at the time of maintenance or the like. Such falling off accompanies a risk of resulting in mechanical interference of the fastener with a mechanism in the fare box or in an electrical short circuit and thereby causing a breakdown of the fare box. In contrast, prevention of falling off of the fastener reduces the risk of casing such a breakdown. Additionally, work of assembling, repair, maintenance or the like can be facilitated because there is no risk that a fastener falls off in attaching and detaching electrical components.

(T) In still another aspect, the fare box comprises a lid-stopper mechanism which supports the lid while keeping the lid open. This configuration makes it possible to hold the lid while keeping the lid open, whereby convenience at the time of maintenance or the like is enhanced. Here, the lid-stopper mechanism may allow stepwise setting of the degree of opening of the lid, or alternatively, may allow the lid to halt before being completely closed in the middle of closing the lid.

(U) In still another aspect, the fare box further comprises a cashbox side communicator, a body side communicator, and a cashbox authentication processor, whereas data on fares can be written from the body side communicator into a memory of the cashbox side communicator. Being provided to the cashbox detachably stored in the main body, the cashbox side communicator receives a radio wave, operates by using the radio wave as a power supply, and transmits an ID code unique to the cashbox. Being provided to the main body, the body side communicator transmits the radio wave and receives the ID code. The cashbox authentication processor authenticates the cashbox on the basis of the received ID code. According to this con-figuration, it is possible to store not only ID information but also the data on fares in the memory of the cashbox side communicator.

(V) In still another aspect, the fare box comprises a bill validating module and a bill feeding lower passage. The bill validating module identifies a bill inserted as a fare. The bill feeding lower passage functions as a passage used for feeding, to the cashbox, a bill discharged from the bill validating module. The bill feeding passage has a curving portion. According to this configuration, it makes it difficult for a person to peep into the bill feeding lower passage to see the inside of the cashbox located at the end of the passage.

(W) In still another aspect, the fare box comprises a coin validating module, a coin feeding lower passage, and coin illicit-jamming detector. The coin validating module identifies a coin casted as a fare. The coin feeding lower passage functions as a passage used for feeding, to the cashbox, a coin discharged from the coin validating module.

The coin illicit-jamming detector detects when a coin is stuck in the coin feeding passage. According to this configuration, it is possible to detect when a coin is stuck outside the entrance of the cashbox, and an illicit act of stealing coins therefore is highly effectively prevented.

(X) In still another aspect, the main body is separable into a box upper part and a box lower part, and it is possible to integrally assemble these box upper part and box lower part together by use of plural fasteners. The box upper part comprises a cover and an operator authentication section. The cover conceals at least one of the fasteners. Only when a person is confirmed to have the authority to operate the fastener that is covered by the cover, the operator authentication section permits the person to operate the fastener. According to this configuration, it is possible to prevent the box upper part and the box lower part from being separated by a person who does not have the authority to separate these parts, whereby security is improved. Note that the operator authentication section may take the form of a cylinder lock, which otherwise may be changed to, for example, electronic authentication of the operator ID using encrypted radio communication as appropriate.

The invention claimed is:

1. A fare box for receiving and storing money paid as fares, comprising:

a main body that has an electrical component storage provided inside and comprises a lockable lid in an upper portion thereof, wherein the electrical component storage opens upward when the lid is opened;

a coin validating module that comprises a coin validator and a device side connector, and is detachably stored in the electrical component storage, wherein the coin validator determines whether a coin received from a coin acceptor is a true coin and identifies the denomination thereof, and the device side connector is provided in a downward-facing manner;

a coin normal transportation passage that transports coins determined by the coin validator to be true to a cashbox;

a bill normal receiving opening that opens on an outer face of the main body and receives a bill;

a bill validating module that comprises a bill validator and a device side connector, and is detachably stored in the electrical component storage, wherein the bill validator determines whether a received bill is a true bill and identifies the denomination thereof, and the device side connector is provided in a downward-facing manner;

a bill normal transportation passage that transports bills determined by the bill validator to be true to the cashbox;

a control module that comprises a device side connector provided in a downward-facing manner, is detachably stored in the electrical component storage, and processes collection information on received bills and coins on the basis of the validating results of the coin validator and the bill validator;

a power module that comprises a device side connector provided in a downward-facing manner, and is detachably stored in the electrical component storage, and supplies power at least to the coin validator, the bill validator and the control module; and electrical component connectors that comprise main body side connectors when the coin validator, the bill validator, the control module and the power module are inserted from above and stored in predetermined positions.

2. The fare box according to claim 1, the coin validating module, the bill validating module, the control module and the power module, which are electrical components stored in the electrical component storage, are provided with fasteners detachably fixing the respective electrical components to the main body.

3. The fare box according to claim 2, the bill validating module, the coin validating module, the control module, and the power module, are arranged so as to line up in a direction along a horizontal plane in the main body.

4. The fare box according to claim 3, the main body is separable into a box upper part and a box lower part, wherein the box upper part comprises a cover that conceals at least one of the fasteners and an operator authentication section that permits a person to operate the fastener only when the person is confirmed to have the authority to operate the fastener, and integrally assembling the box upper part and box lower part together by the fasteners.

* * * * *